US008410383B2

(12) United States Patent
Clark et al.

(10) Patent No.: US 8,410,383 B2
(45) Date of Patent: Apr. 2, 2013

(54) SWITCH DISPLAY ASSEMBLY WITH SEAL

(75) Inventors: James T. Clark, Spokane, WA (US); Peter R. Bokma, Otis Orchards, WA (US); Chris Weber, Coeur d'Alene, WA (US); Doug Krumpelman, Hayden, ID (US)

(73) Assignee: Advanced Input Devices, Inc., Coeur d'Alene, ID (US)

( * ) Notice: Subject to any disclaimer, the term of this patent is extended or adjusted under 35 U.S.C. 154(b) by 316 days.

(21) Appl. No.: 12/872,848

(22) Filed: Aug. 31, 2010

(65) Prior Publication Data

US 2011/0048909 A1 Mar. 3, 2011

Related U.S. Application Data

(60) Provisional application No. 61/373,011, filed on Aug. 12, 2010, provisional application No. 61/238,594, filed on Aug. 31, 2009.

(51) Int. Cl.
*H01H 3/20* (2006.01)

(52) U.S. Cl. ..... 200/330; 200/314

(58) Field of Classification Search ..... 200/314
See application file for complete search history.

(56) References Cited

U.S. PATENT DOCUMENTS 6,310,308 B1 * 10/2001 Watson et al. ..... 200/520
7,038,598 B2 * 5/2006 Uke ..... 341/20

FOREIGN PATENT DOCUMENTS

EP 0221698 A2 5/1987
EP 0232137 A2 8/1987
FR 2602609 A1 2/1988
WO 2006/040577 A1 4/2006

OTHER PUBLICATIONS

Invitation to Pay Additional Fees and Partial International Search Report dated Nov. 18, 2010, issued in corresponding International Application No. PCT/US2010/047356, filed Aug. 31, 2010.
International Search Report and Written Opinion mailed Jan. 21, 2011, issued in corresponding International Application No. PCT/US2010/047356, filed Aug. 31, 2010.

* cited by examiner

*Primary Examiner* — Vanessa Girardi
(74) *Attorney, Agent, or Firm* — Christensen O'Connor Johnson Kindness PLLC

(57) ABSTRACT

The present disclosure provides a switch assembly including a lens having a hollow interior, a display at least partially received within the hollow interior of the lens, an actuator moveably engageable by the lens, and an elastomeric switch activatable by the actuator in response to movement of the lens. The elastomeric switch may include a circuit assembly, a sealing switch layer disposed over the circuit assembly, and an elastomeric switch member formed within the sealing switch layer that is actuatable by the movement of the lens for engagement with the circuit assembly.

21 Claims, 20 Drawing Sheets

SWITCH DISPLAY ASSEMBLY WITH SEAL

CROSS-REFERENCE TO RELATED APPLICATIONS

This application claims the benefit of U.S. Provisional Patent Application No. 61/373,011, filed Aug. 12, 2010, and U.S. Provisional Patent Application No. 61/238,594, filed Aug. 31, 2009, the disclosures of which are hereby expressly incorporated by reference herein.

BACKGROUND

Gaming units or devices, such as slot machines, include at least one button assembly that must be depressed by a player to interact with the gaming unit. Multiple button assemblies may be configured together as a "programmable button panel" (PBP) on the gaming unit, wherein a player may press one of the button assemblies to cause the gaming unit to perform various functions, such as cash out, select pay lines, display the pay table on a video display, enter a wager, spin the reels, etc. Each button assembly typically includes a variety of components, such as a button, an actuator, a switch, and a light and/or electronic display source.

The actuator, switch, and light/electronic display source are generally positioned beneath the button. The actuator is coupled to the button and disposed to activate the switch in response to pressing the button. The light source may be positioned to illuminate at least a portion of the button when the button is active or after the button has been depressed. The electronic display source may consist of a liquid crystal display (LCD) or an organic light-emitting diode (OLED) that is programmable to display unique graphical images depending on the function selected by the user, the game being played, etc. The button may further include a seal or other feature designed to help prevent damage to the components of the button assembly if, for instance, a liquid is spilled on the button assembly during use.

A brief description of a prior art design of a PBP 10 having first and second button or switch assemblies 12 and 14 will be hereinafter described with reference to FIGS. 1-3. Although the prior art PBP 10 is shown having first and second switch assemblies 12 and 14, it should be appreciated that the PBP 10 may instead include only one switch assembly or three or more switch assemblies. Moreover, the first and second switch assemblies 12 and 14 are substantially identical in design; and therefore, a majority of the description of the PBP 10 will be described with reference only to the first switch assembly 12 for the sake of brevity.

The first switch assembly 12 includes a transparent button or lens 18 that covers and partially encloses a display/printed circuit board (PCB) assembly 20, an actuator assembly 24, and a switch PCB 32. The lens 18 is moveably receivable within an opening defined in a sheet metal frame 22 and surrounded by a bezel 26 that is fixedly received within the opening in the sheet metal frame 22.

The display/PCB assembly 20 includes a display 52, such as an LCD or OLED, that is disposed within a hollow interior of the lens 18 such that graphical images shown by the display 52 are viewable through the transparent lens 18. The display 52 is electrically mounted to a display PCB 54 in a manner well known in the art. The display PCB 54 may include a plurality of light-emitting diodes (LEDs) 56 electrically mounted thereto and surrounding the display 52. The display PCB 54 is electrically connected to electrical components of the gaming unit (not shown) through a cable 58 and/or through the switch PCB 32 to selectively illuminate the display 52 and LEDs 56 in response to input signals received from the gaming unit.

The display/PCB assembly 20 is further fixedly and electrically mounted to the switch PCB 32 through a plurality of connector pin assemblies. More specifically, connector pins 62 that are electrically connected to the display PCB 54 extend downwardly from the lower surface of the display PCB 54 and are received into connectors 64 mounted on the switch PCB 32. The connector pins 62 and connectors 64 are appropriately positioned such that the actuator assembly 24 may be positioned between the display/PCB assembly 20 and the switch PCB 32.

The actuator assembly 24 includes a bracket 68 that is suitably shaped and sized to fit between the display PCB 54 and the switch PCB 32 without interfering with the connector pins 62. The bracket 68 is moveable in the vertical direction in response to the movement of the lens 18. More specifically, the bracket 68 defines first, second, third, and fourth actuator post assemblies 70, 72, 74, and 76, respectively, at each corner of the bracket 68 that are engageable with and moveable by the lens 18 to cause movement of the bracket 68.

Each actuator post assembly 70, 72, 74, and 76 includes a lens-engaging post 78 extending transversely upwardly from the bracket 68. The lens-engaging post 78 is of a suitable length such that it may extend upwardly through openings 94 formed in the display PCB 54 and engage a respective corner of the lens 18. As such, when the lens 18 is depressed by a player, the lens 18 applies a load to the posts 78 to move the bracket 68 of the actuator assembly 24 downwardly.

Each actuator post assembly 70, 72, 74, and 76 further includes a plunger 80 extending downwardly from the bracket 68 and slightly outwardly from the center of the bracket 68. The plungers 80 are made from a rigid material but can flex at least somewhat inwardly such that they are receivable within corresponding openings 82 formed in the switch PCB 32. Upon disposing the plungers 80 within the openings 82, the plungers are urged back into their natural state to retain the plunger 80 within the switch PCB 32. Moreover, a compression spring 84 is disposed on each plunger 80 and is positioned between the bracket 68 and the switch PCB 32 to continuously urge the plunger 80, and therefore the bracket 68 and lens 18, upwardly away from the switch PCB 32 into a released, non-depressed position. A lip is formed at the end of each plunger 80 to define a snap-fit between the plunger 80 and the switch PCB 32.

The switch assembly 12 includes an optical sensor that is configured to open and close a switch upon activation by the actuator assembly 24. The optical sensor includes an emitter 86 disposed opposite a receiver 88 on the display PCB 54. A slot 92 is formed in the display PCB 54 between the emitter 86 and receiver 88 and is sized to selectively receive a flag 90 therebetween. The flag 90 is coupled to or formed on the bracket 68 of the actuator assembly 24 such that the flag 90 travels up and down with the bracket 68. The emitter 86 emits light, and the switch is closed (or opened, depending on the configuration) when the bracket 68 and lens 18 are urged into the depressed position and the flag 90 moves between the emitter 86 and the receiver 88 and blocks, or breaks the beam of light.

To assemble the PBP 10, the switch PCB 32 is mounted to a bottom cover 36 through a plurality of fasteners 38 and snap-features 46. The fasteners 38 pass through the bottom cover 36 and are received within columns or stand-offs 40. The bracket 68 of the actuator assembly 24 is moveably secured to the switch PCB 32 by passing the plungers 80 into the openings 82 defined in the switch PCB 32. The display/

PCB assembly 20 is secured to the switch PCB 32 by securing the connector pins 62 within the connectors 64 on the switch PCB 32. The sheet metal frame 22 is coupled to the switch PCB 32 through a plurality of screws 44 extending downwardly from the bottom surface of the sheet metal frame 22 that are receivable within the stand-offs 40. A sheet metal spring 48 is disposed between the sheet metal frame 22 and the switch PCB 32 to assist in mounting of the sheet metal frame 22 to a gaming unit.

The above-described PBP 10 has numerous drawbacks, which include the following. First, it can be appreciated that a gaming unit typically includes a PBP having many switch assemblies. As such, the footprint of each switch assembly necessarily must be small and therefore must include even smaller internal components. Thus, it can be appreciated that the design of the above-described switch assembly 12 is extremely complex. The actuator assembly 24 includes many small, intricate pieces (bracket 68, actuator post assemblies 70, 72, 74, and 76, springs 84, deformable plungers 80 having lips formed on each end, flags 90, etc.) that must be precisely designed and fabricated to function properly and fit within the small footprint of the switch assembly 12.

It should further be appreciated that a gaming environment is abusive in that the switch assembly 12 is typically subjected to high mechanical loads. For instance, the player will often pound or bang on the buttons due to the excitement or frustration of playing the game rather than simply pressing the button. This subjects the small, delicate components of the switch assembly 12 to high loads and decreases the life of the components. Moreover, even under normal loads, the small, delicate components of the switch assembly 12 will wear out or fail over time. As a non-limiting example, the plungers 80 will wear down due to abrasion against the switch PCB 32 and will lose their structural properties from the repeated stress during movement of the actuator assembly 24. Such weaknesses in the design will necessarily cause the switch assembly 12 to function inadequately, fail or fall apart over time.

It should further be appreciated that in the gaming environment, a player is often consuming a beverage while playing (as most casinos offer a free beverage while playing), and it is common that a beverage will be spilled onto the switch assembly. Thus, it is desired to include features within the switch assembly that help prevent the internal components from getting wet. Moreover, it is typically desirable to be able to clean the switch assembly if, for instance, the beverage or other liquid contains sugars or other sticky substances. For instance, when a sugary beverage (e.g. beer, soda, etc.) is spilled onto the switch assembly, a sugary residue will remain within the interior of the switch assembly after the liquid evaporates. This residue can not only damage the internal components, but it can also cause moveable components to stick together, thereby rendering the switch assembly inoperable. Thus, it is desirable to be able clean the switch assembly by, for instance, spraying down the switch assembly with water or another cleaning substance.

The above-described switch assembly 12 is not suitably spill-resistant or designed to be adequately cleaned after a liquid is spilled onto the switch assembly 12. For instance, although the lens 18 helps prevent liquids from reaching the display/PCB assembly 20, the lens does not prevent liquids from reaching the moveable components of the actuator assembly 24 or the electrical components of the switch PCB 32. Moreover, with the design of the switch assembly 12 being complex and including many small parts, it would be difficult to modify the design to seal portions of the switch assembly 12 to help make the internal components resistant to environmental conditions such as spillage.

Finally, it should be appreciated that the switch assembly 12 is expensive to manufacture and produce due to the large number of small, intricate, delicate pieces used within the assembly. As mentioned above, the pieces must be precisely fabricated to function properly and fit within the small footprint of the switch assembly 12. Moreover, the switch assembly 12 uses a relatively expensive optical sensor assembly configured to open and close a switch upon the depression and release of the lens 18. Thus, the complex design of the switch assembly 12 as well as the high-cost components increase the overall cost of the switch assembly 12.

Thus, it is desired to have a switch assembly suitable for a gaming environment or another similar environment that is simple in design, made with durable components, easy to manufacture and produce, low in cost, resistant to spills, and easy to clean.

SUMMARY

The present disclosure provides a switch assembly including a lens having a hollow interior, a display at least partially received within the hollow interior of the lens, an actuator moveably engageable by the lens, and an elastomeric switch activatable by the actuator in response to movement of the lens. The elastomeric switch may include a printed circuit board, a sealing switch layer disposed over the printed circuit board, and an elastomeric switch member formed within the sealing switch layer that is actuatable by the movement of the lens for engagement with the printed circuit board.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the present disclosure will become more readily appreciated as the same become better understood by reference to the following detailed description, when taken in conjunction with the accompanying drawings, wherein.

DETAILED DESCRIPTION

A switch assembly 100 formed in accordance with one embodiment of the present disclosure may best be seen by referring to FIGS. 4-7. The switch assembly 100 will be hereinafter described with reference to a gaming environment; however, it should be appreciated that the switch assembly 100 may instead be used in any suitable or similar environment. Moreover, the switch assembly 100 may be integrated within a device having only a single switch assembly or instead within a device having multiple switch assemblies defining a programmable button panel (PBP). Thus, the following description should not be seen as limiting the scope of the claimed subject matter.

Figure 1:
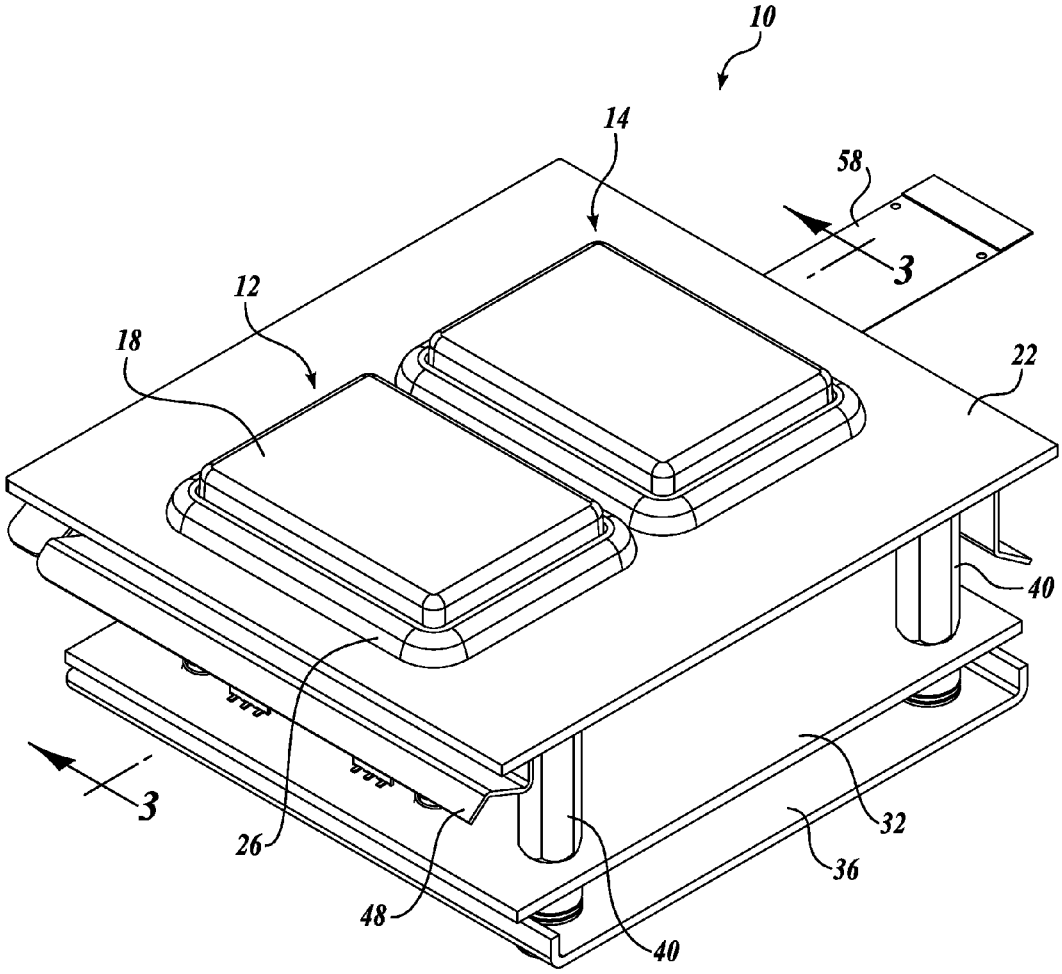
Fig.1. (PRIOR ART)
FIG. 1 is an isometric view of a prior art programmable button panel having first and second switch assemblies.
Figure 2:
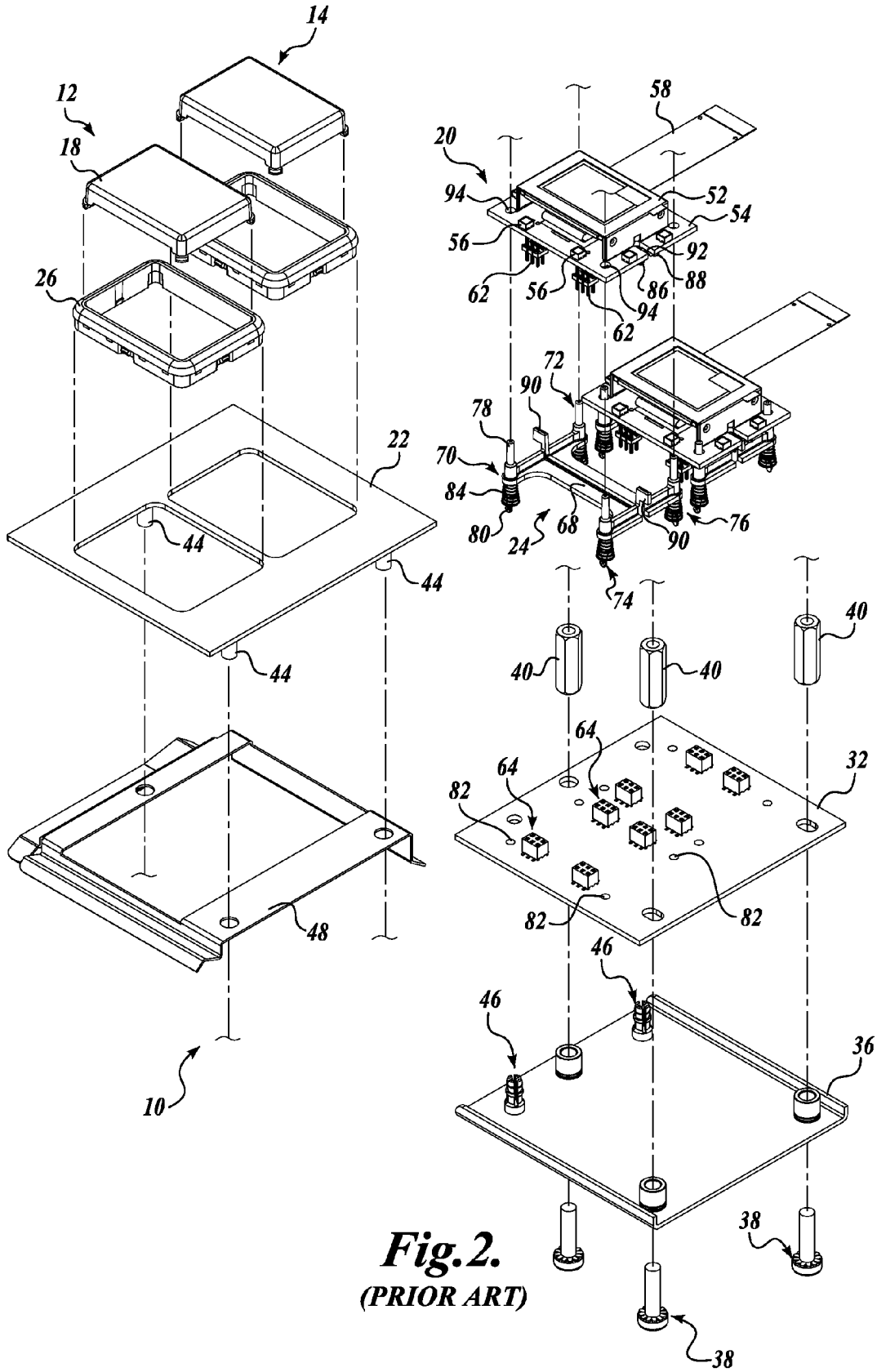
Fig.2. (PRIOR ART)
FIG. 2 is an isometric exploded view of the prior art programmable button panel of FIG. 1.
Figure 3:
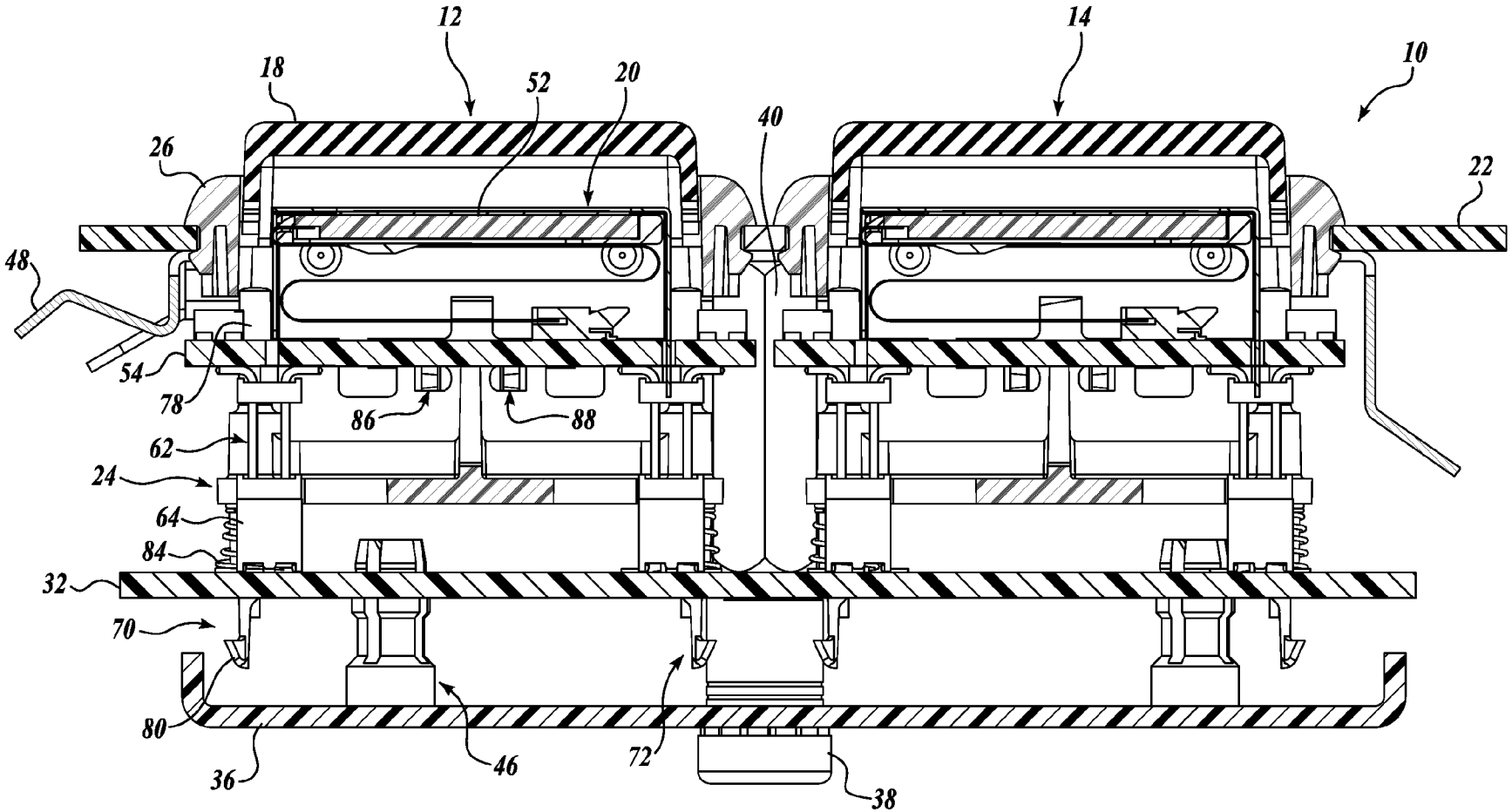
FIG. 3 is a cross-sectional view of the prior art programmable button panel of FIG. 1, taken substantially across line 3-3.
Figure 4:
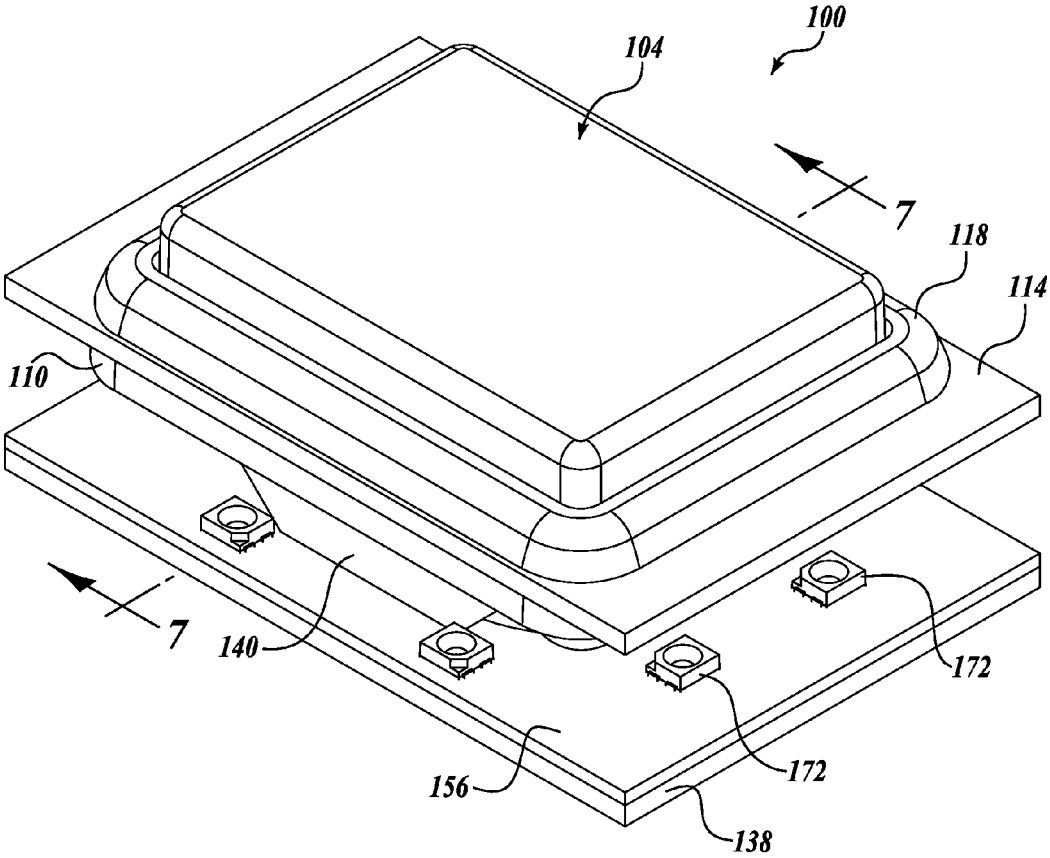
FIG. 4 is an isometric view of a switch assembly formed in accordance with one embodiment of the present disclosure.
Figure 5:
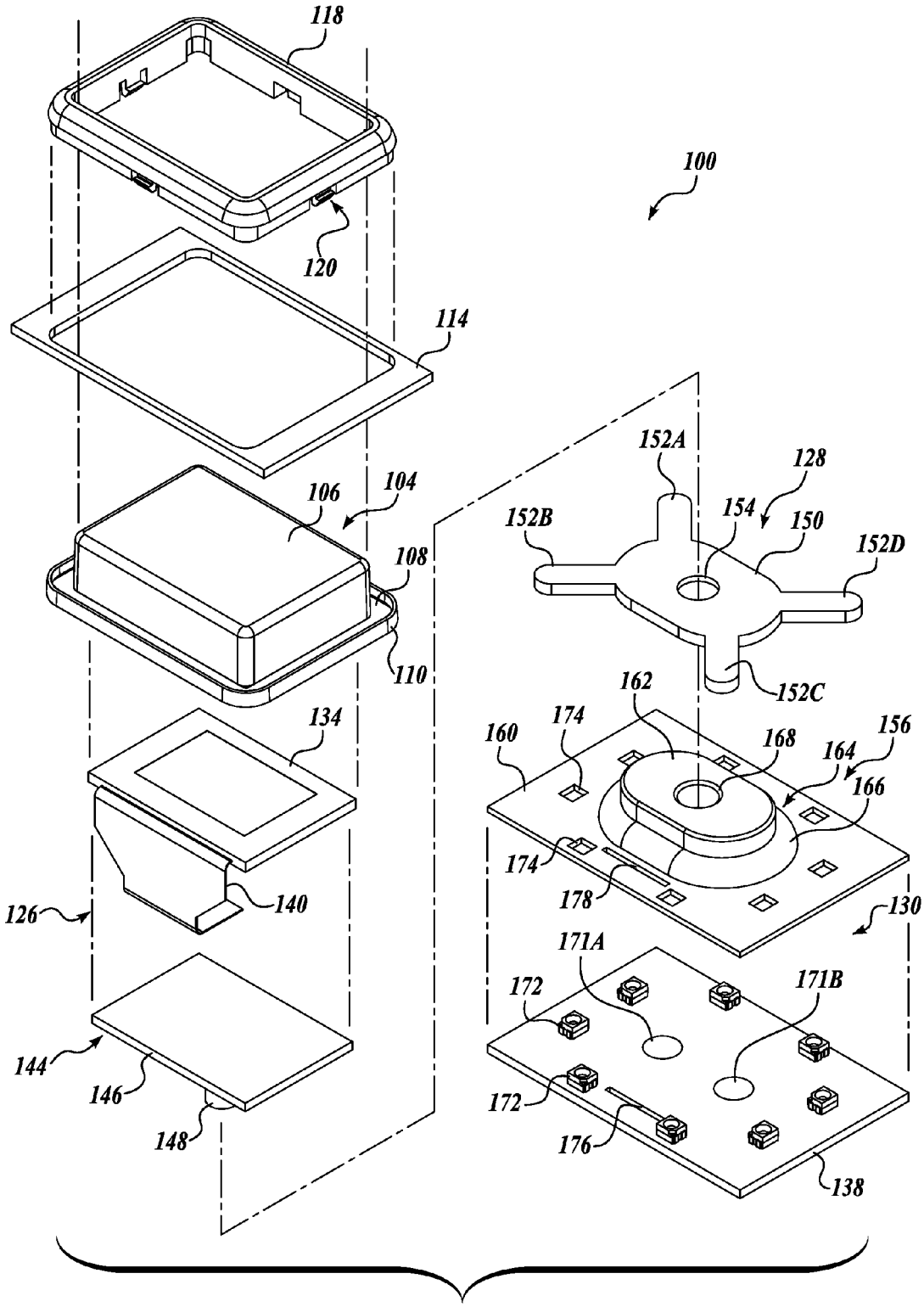
FIG. 5 is a top isometric exploded view of the switch assembly of FIG. 4.

Referring to FIGS. 4 and 5, the switch assembly 100 includes a transparent or translucent button or lens 104 having a hollow rectangular portion 106 defining a bottom opening and a flange 108 extending substantially transversely from the bottom, open edge of the hollow rectangular portion 106. A raised lip 110 extends substantially transversely from the upper surface of the flange 108 around the outer edge of the flange 108. The flange 108 and raised lip 110 are configured to capture a predetermined amount of liquid spilt onto the switch assembly 100 and guide the liquid into a drain hole 112 formed in the flange 108 (see FIG. 6). The liquid passing through the drain hole 112 is guided away from the components disposed beneath the lens 104 and onto certain portions of the interior of the switch assembly 100.

The rectangular portion 106 of the lens 104 is receivable within an opening in a frame 114 made of sheet metal, plastic, etc., that is substantially flat such that it may define a portion of a panel of a gaming device or another suitable device. A bezel 118 is receivable within the opening in the frame 114 and protrudes upwardly therefrom to surround the lens 104 such that the bezel 118 may act as a guide for vertical movement of the lens 104 when being depressed by a player. The bezel 118 may be any suitable or desired shape and configuration appropriate to guide the lens 104 when being moved. Moreover, the bezel 118 may be secured within the opening in the frame 114 in any suitable manner, such as with a plurality of snap locking features 120 that allow the bezel 118 to be snap-fit within the frame 114. Furthermore, it should be appreciated that the bezel 118 and frame 114 may instead be formed as one integral piece, such as through injection molding or by other suitable means.

It should be appreciated that the lens 104 and bezel 118, as well as the other components of the switch assembly 100 that will be hereinafter described may be any suitable shape and size. For instance, the switch assembly 100 may instead be of an overall circular shape or another irregular shape. Thus, the description and illustrations provided herein should not be seen as limiting the scope of the present disclosure.

Figure 6:
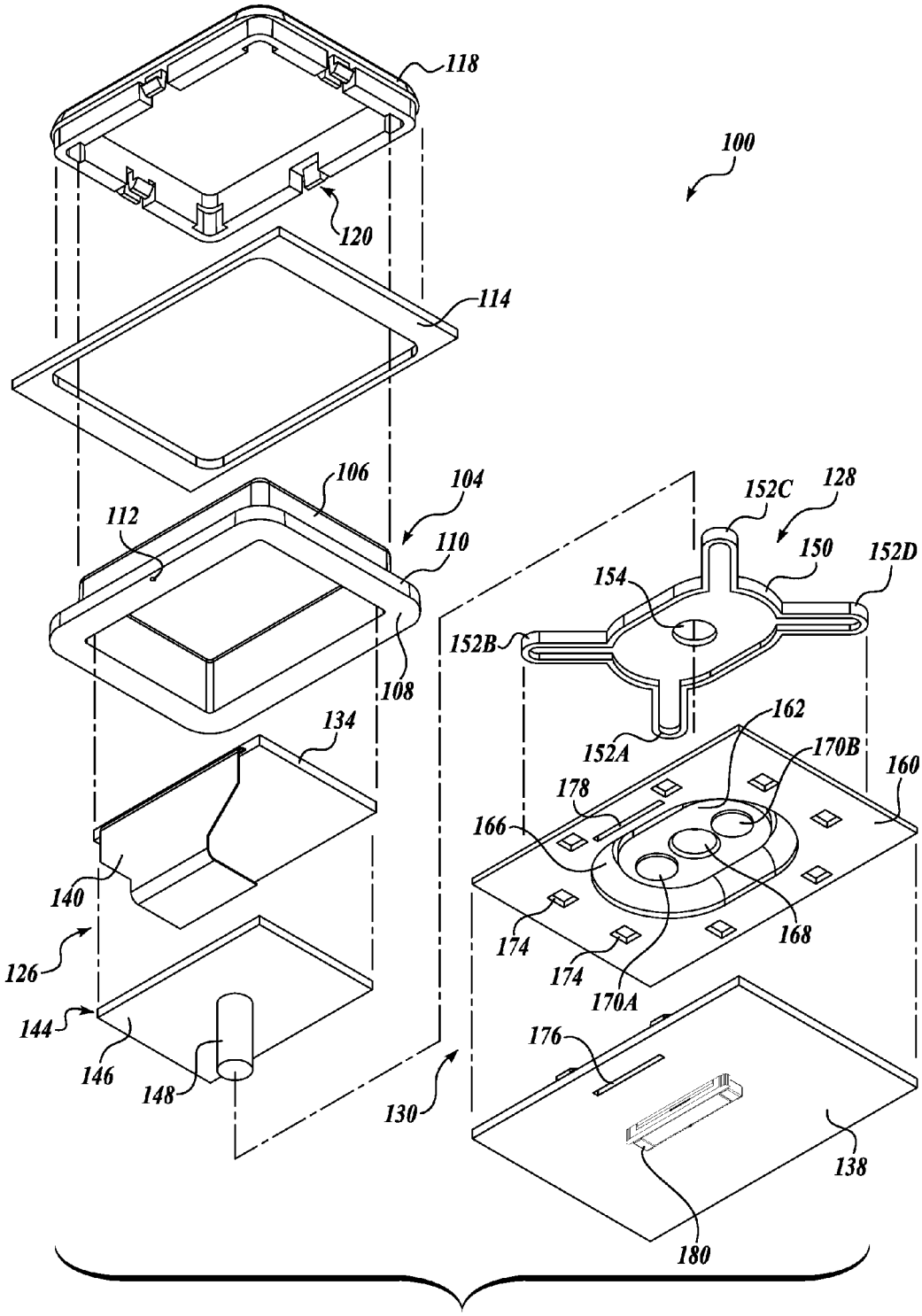
FIG. 6 is a bottom isometric exploded view of the switch assembly of FIG. 4.

Referring to FIGS. 5 and 6, the lens 104 covers and substantially encloses a display assembly 126 positioned above an actuator 128 and an elastomeric switch 130. The display assembly 126 includes a display 134, such as a liquid crystal display (LCD) or an organic light-emitting display (OLED), that is electrically connected to a switch/lighting electrical circuit assembly 138 of the elastomeric switch 130 through a cable 140 preferably in the form of a well-known flexible tail or another suitable flexible circuit or data cable. The display 134 is preferably programmable to display unique graphical images depending on the function selected by the player, the game being played, etc. For instance, the image on the display 134 may change when the elastomeric switch 130 is opened or closed by the actuator 128 in response to movement of the lens 104.

It should be appreciated that any suitable display now known or later developed may be used. Moreover, rather than using an electronic display that is programmable to display different images, it should be appreciated that a simple graphical image formed on a substrate (such as paper, film, etc.) may instead be used. The display 134 is sized and shaped such that it is receivable within the hollow rectangular portion 106 of the lens 104 so that the images on the display 134 are visible through the lens 104.

The display 134 is mounted on a display mount 144 configured to appropriately position the display 134 within the rectangular portion 106 of the lens 104. Although any suitable mounting structure may be used, the display mount 144 preferably includes a flat portion 146 that is substantially similar or identical in size and shape to the display 134. The display 134 may be mounted to the flat portion 146 in any suitable manner, such as with adhesive or other suitable fasteners. The display mount 144 further includes a post 148 extending transversely downwardly from the bottom surface of the flat portion 146. The post 148 is of a suitable length such that it may extend through the actuator 128 and sealing switch layer 156, respectively, to abut against a portion of the elastomeric switch 130 and position the display 134 in a desired vertical location beneath the lens 104. Preferably, the display 134 is mounted a sufficient distance below the interior upper surface of the lens 104 such that the display 134 may remain substantially stationary when the lens 104 is moved between the depressed and released position, yet the images on the display 134 are visible through the lens 104. However, it should be appreciated that in alternate embodiments, the display 134 may be secured within the switch assembly 100 such that it is moveable with the lens 104.

Referring still to FIGS. 5 and 6, the actuator 128 and elastomeric switch 130 will now be described in detail. The actuator 128 is positioned beneath the stationary display assembly 126 yet configured to be moved by the lens 104 when depressed to activate the elastomeric switch 130. To effectuate this function, the actuator 128 is preferably a substantially planar structure having an overall outline that substantially matches the lens 104 such that the lens 104 may moveably engage the actuator. Moreover, the actuator 128 includes an opening 154 sized and configured to slidably receive the post 148 of the display mount 144 such that the actuator may move with the lens 104 relative to the display assembly 126.

Although the actuator 128 may be any suitable shape and size to carry out the above-described function, the actuator preferably includes a substantially flat body portion 150 and first, second, third, and fourth radially projecting fingers 152A, 152B, 152C, and 152D, respectively, extending outwardly from the body portion 150 along substantially the same plane as the body portion 150. The fingers 152A-152D are positioned to engage a respective corner of the flange 108 surrounding the lens 104 when the lens 104 is depressed.

The actuator 128 is further configured to effectively engage and activate (i.e., open or close) the elastomeric switch 130 when the lens 104 is depressed. The elastomeric switch 130 is comprised of a sealing switch layer 156 disposed above a switch/lighting electrical circuit assembly 138, such as a printed circuit board (PCB) or another suitable circuit assembly. The sealing switch layer 156 comprises a sealing body portion 160 sized and shaped to substantially cover and seal the switch/lighting circuit assembly 138. A well-known elastomeric switch member 164 is formed in the sealing switch layer 156 and may be integrally formed with the sealing body portion 160. The sealing switch layer 156 may be formed from any suitable, well known elastomeric, water-resistant or water-proof material, such as silicone rubber. In this manner, the sealing switch layer 156 seals the switch/lighting circuit assembly 138 and helps prevent liquids from reaching the circuit assembly 138. Moreover, the sealing switch layer 156 can protect the switch/lighting circuit assembly 138 if, for instance, cleaning liquids are poured over the switch assembly 100 to remove dirt, residue, etc.

As can be appreciated by one of ordinary skill in the art, the elastomeric switch member 164 is a well-known portion of a switch configured to open or close the switch/lighting circuit assembly 138 when a portion of the elastomeric switch member is depressed and engages the switch/lighting circuit assembly 138. However, for ease of understanding, a brief description of the elastomeric switch 130 having an elastomeric switch member 164 will be hereinafter provided.

The elastomeric switch member 164 includes a key 162 that is three-dimensionally shaped and defines a hollow interior. The body portion 150 of the actuator 128 is engageable with the key 162 to depress the elastomeric switch member 164 into engagement with the switch/lighting circuit assembly 138. The key 162 includes an opening 168 configured to sealingly receive the post 148 of the display mount 144 such that the key 162 may move independently of the display assembly 126 when activated by the actuator 128.

Preferably, the key 162 and the body portion 150 of the actuator 128 are substantially similar or identical in overall shape and size such that the body portion 150 of the actuator 128 is engageable with substantially the entire top surface of the key 162 when the body portion 150 is aligned with the key 162. In this manner, when the lens 104 is depressed and applies a load against radially projecting fingers 152A, 152B, 152C, and 152D, the load is transferred to the body portion 150, which applies a substantially evenly-distributed load to the key 162. As such, the elastomeric switch member 164 can evenly and reliably engage the switch/lighting circuit assembly 138 to open or close the elastomeric switch 130.

As shown in FIG. 6, first and second circuit-closing contacts 170A and 170B, or "carbon pills" as are well known in the art, are embedded within the key 162 near the bottom interior surface of the key 162. Each circuit-closing contact 170A and 170B is formed within the key 162 and is engageable with traces 171A and 171B (see FIG. 5) on the switch/lighting circuit assembly 138 when the key 162 is depressed by the actuator 128. The circuit-closing contacts 170A and 170B are covered with a conductive rubber material such that they close one or more circuits when coming into contact with the traces 171A and 171B on the circuit assembly 138. It can be understood from the above description that the elastomeric switch member 164 uses inexpensive, simple parts to open or close the elastomeric switch 130, as opposed to the costly optical sensor assembly described above with respect to the prior art switch assembly 12. The elastomeric switch member 164 further provides the advantage of using fewer parts that are simple in design to continuously urge the lens 104 into a released (non-depressed) position and to create a tactile sensation of a fully depressed lens. As discussed above, the prior art switch assembly 12 uses a plurality of springs 84 and deformable plungers 80 having snap features to allow the lens 18 to move into the depressed position and to urge the lens 18 into the released, non-depressed position. The elastomeric switch member 164, on the other hand, includes a simple fillet or web 166 encircling the key 162 that is configured to urge the key 162 (and therefore the actuator 128 and lens 104) into the released, non-depressed position and provide a tactile sensation, or a snap-like feeling, when the player applies a predetermined force to the lens 104. The web 166 extends from the key 162 to the base portion 160 at substantially a forty-five degree)(45° angle around the perimeter of the key 162. When the actuator 128 applies a predetermined amount of force on the key 162, the web 166 buckles (see FIG. 7B) to allow the key 162 to move downwardly into contact with the switch/lighting circuit assembly 138 and to provide a tactile response of a fully depressed lens.

As can be understood by one or ordinary skill, the web 166 can vary in angle, thickness, nominal height, contour, etc., to increase or decrease the predetermined amount of force required to cause the web 166 to buckle and to produce an increased or decreased tactile response. Moreover, the web 166 may instead be varied in design to generate a linear force when depressed or released rather than providing a tactile sensation. Thus, the foregoing should not be seen as limiting the scope of the claimed subject matter.

As can be appreciated from the foregoing description, the elastomeric switch member 164 further has a lifespan much greater than the small, delicate pieces of the prior art switch assembly 12. The web 166 must simply buckle to move the circuit-closing contacts 170A and 170B into engagement with the switch/lighting circuit assembly 138, as opposed to the combination of the springs 84 and plungers 80 that will fail due to abrasion, stress, and deformation. Moreover, the elastomeric material of the elastomeric switch member 164 can better absorb forces applied to the switch assembly 100 in the abusive gaming environment, as opposed to the small, delicate pieces of the prior art switch assembly 12 that are more susceptible to breaking.

Notwithstanding the foregoing, it should be appreciated that the elastomeric switch 130 may instead include a membrane switch, mechanical switch, or another suitable switch or combination of switch features disposed beneath or otherwise integrally formed within the sealing switch layer 156. Thus, the scope of the present disclosure should not been seen as limited to the elastomeric switch member 164 described above.

The switch assembly 130, when activated to close a circuit, may send signals to a controller within the gaming unit or to a controller or computer external of the gaming unit through suitable wired or wireless technologies (not shown) well known in the art. Upon receiving the signal that the circuit has been closed, the controller may, for example, output a signal to activate or change the image on the display 134. The switch assembly 100 may further include a plurality of light sources 172, such as light-emitting diodes (LEDs) electrically connected to the switch/lighting circuit assembly 138 that may be illuminated individually or collectively in response to input signals received from the controller, external computer, etc. The light sources 172 are preferably positioned around the exterior perimeter of the switch/lighting circuit assembly 138 such that they may sealingly protrude through openings 174 in the base portion 160 of the sealing switch layer 156 to surround the elastomeric switch member 164 and actuator 128. In this manner, the light sources 172, when activated, may at least somewhat illuminate the lens 104 or an area surrounding the lens.

As can be seen in FIGS. 5 and 6, the base portion 160 of the sealing switch layer 156 further includes a slit 178 sized and configured to sealingly receive the cable 140 of the display 134. The cable 140 also preferably extends through an opening or slit 176 in the switch/lighting circuit assembly 138 such that the cable 140 may be connected to the circuit assembly 138 through a connector 180 located on the bottom surface of the circuit assembly 138. In this manner, the connector 180 does not interfere with the switch assembly 130 when it is activated by the actuator 128.

Figure 7A:
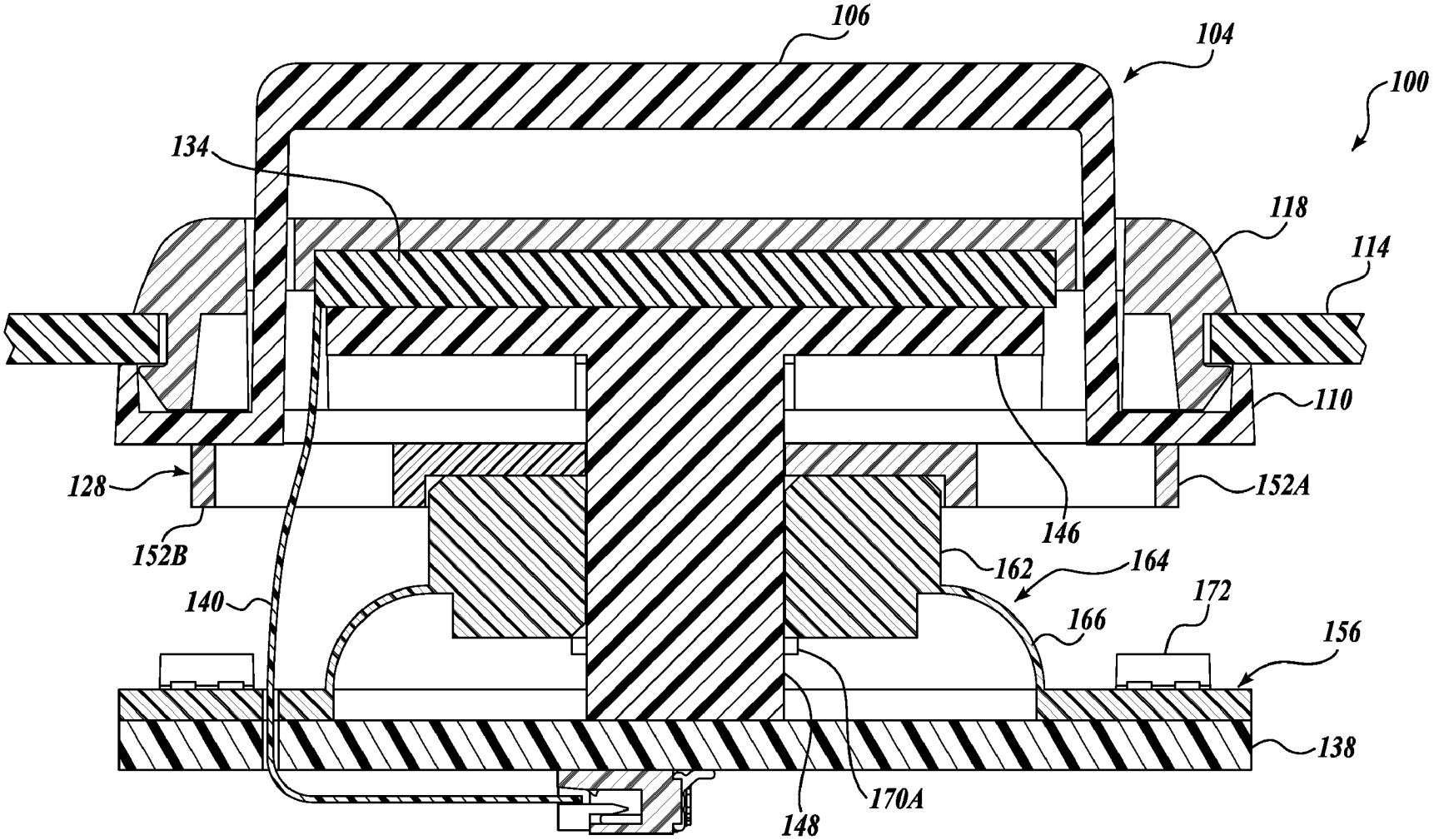
FIG. 7A is a cross-sectional view of the switch assembly of FIG. 4 taken substantially across line 7-7, wherein the switch assembly is shown in a first position.
Figure 7B:
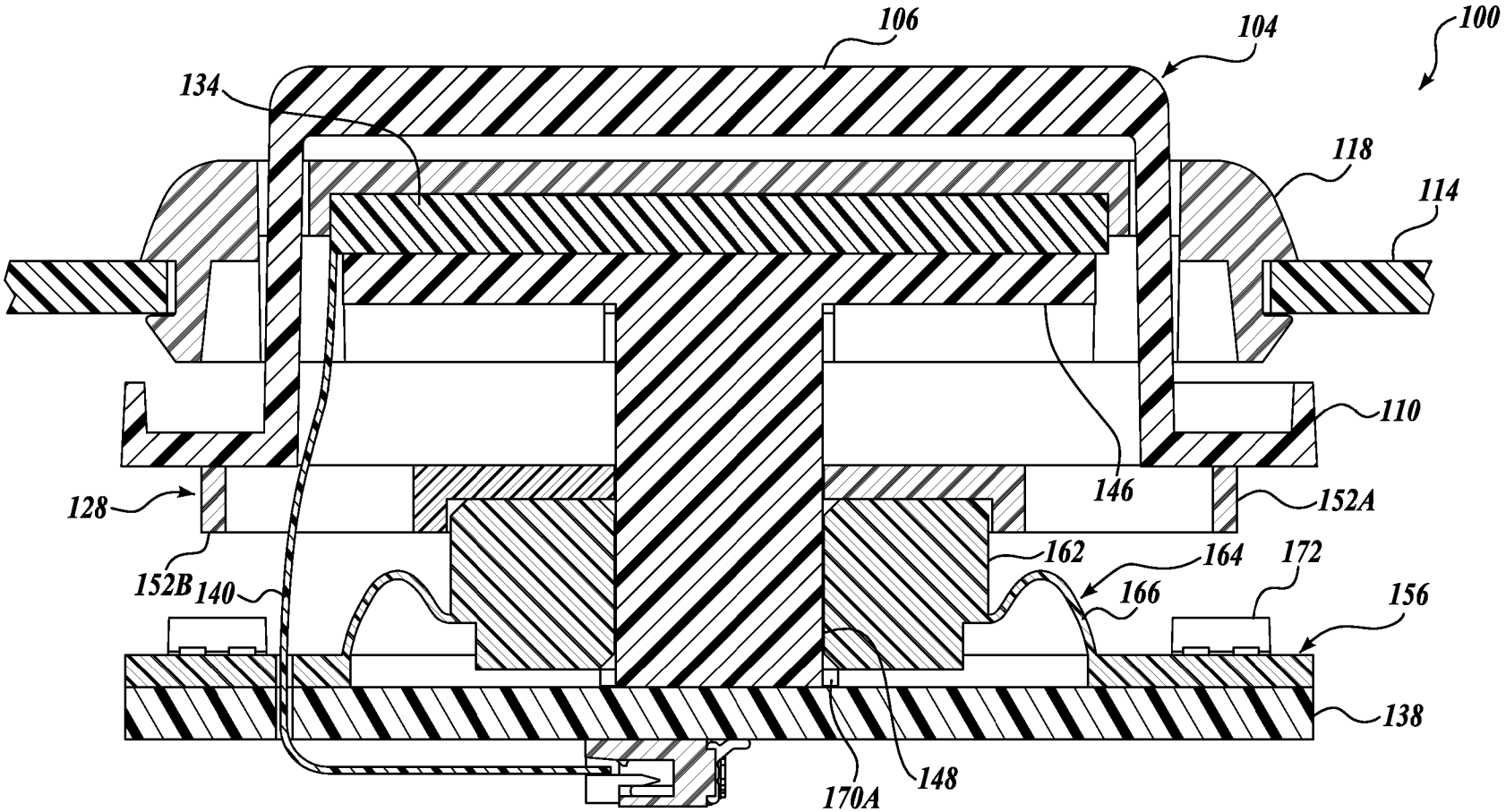
FIG. 7B is a cross-sectional view of the switch assembly of FIG. 4 taken substantially across line 7-7, wherein the switch assembly is shown in a second position.

Referring to FIGS. 7A and 7B, to operate the switch assembly 100, a player applies a predetermined load to the lens 104 (for instance, with his or her finger), and the flange 108 of the lens 104 applies the load to the radially projecting fingers 152A, 152B, 152C, and 152D of the actuator 128. The load is transferred from the radially projecting fingers 152A, 152B, 152C, and 152D to the body portion 150 of the actuator 128, which transfers the load to the key 162 of the elastomeric switch member 164. The web 166 of the elastomeric switch member 164 buckles under the predetermined load and allows the key 162 to move downwardly into engagement with the switch/lighting circuit assembly 138 until the circuit-closing contacts 170A and 170B come into contact with the traces 171A and 171B (not shown in FIGS. 7A and 7B) on the switch/lighting circuit assembly 138 and close the circuit of the elastomeric switch 130. As the lens 104, actuator 128, and elastomeric switch member 164 move in response to the predetermine load, the display assembly 126 remains substantially stationary within the interior of the lens 104 (see FIG. 7B).

If a liquid is poured over the switch assembly 100, at least a certain volume of the liquid will be captured by the flange 108 and raised lip 100 of the lens 104 and will be guided down through the drain hole 112 into the interior of the switch assembly 100 without coming into contact with the display 134 disposed beneath the lens 104. If a larger volume of liquid is spilled onto the switch assembly 100, the liquid will flow onto the flange 108 of the lens 104 and will be guided onto the sealing switch layer 156 of the elastomeric switch 130. Any components sealed beneath the sealing switch layer 156, such as the switch circuit assembly 138, remain substantially dry. Moreover, with the display 134 being received within the rectangular portion 106 of the lens 104, the display 134 remains protected by the lens 104 and stays substantially dry. Thus, the liquid-guiding flange 108 of the lens 104 as well as the sealing switch layer 156 of the elastomeric switch 130 help prevent the switch assembly 100 from being damaged when liquid is spilled onto the assembly.

Figure 8:
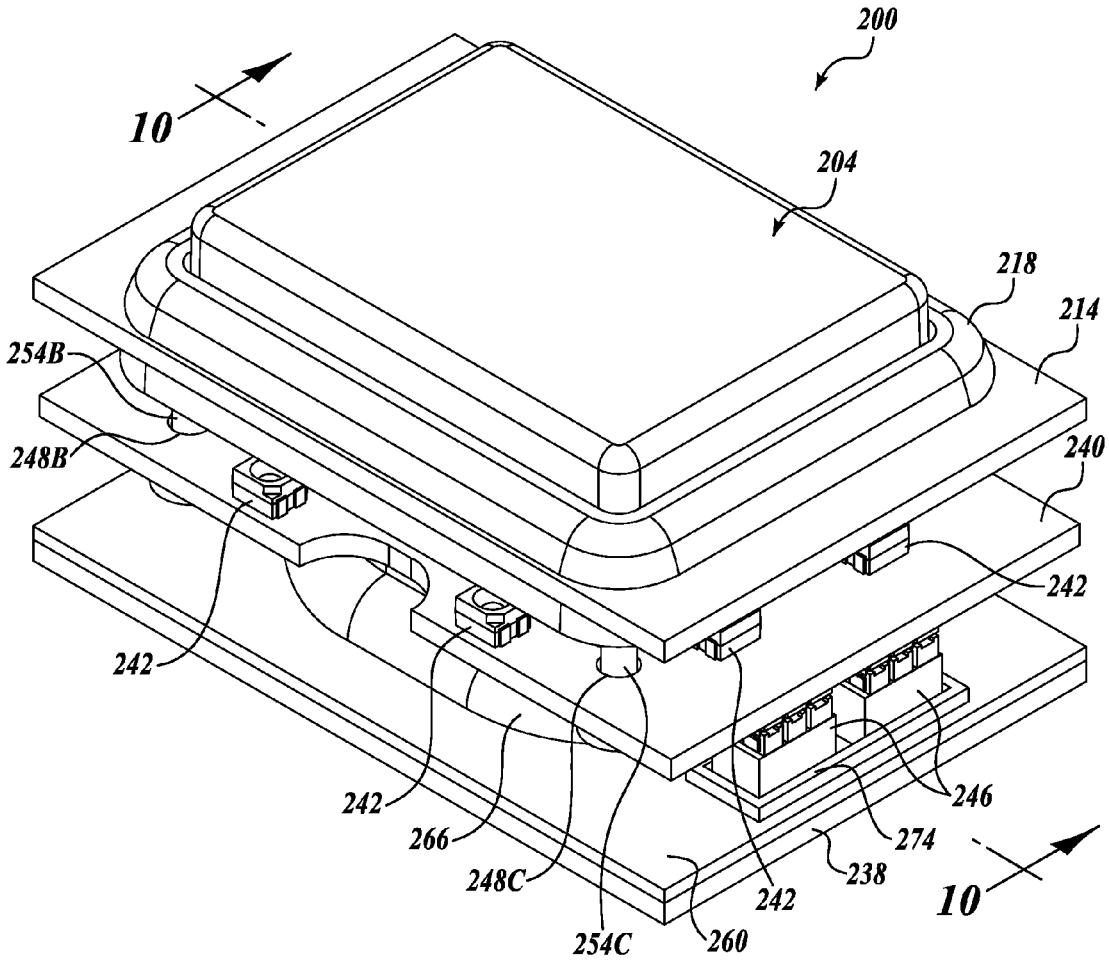
FIG. 8 is an isometric view of a switch assembly formed in accordance with another embodiment of the present disclosure.
Figure 9:
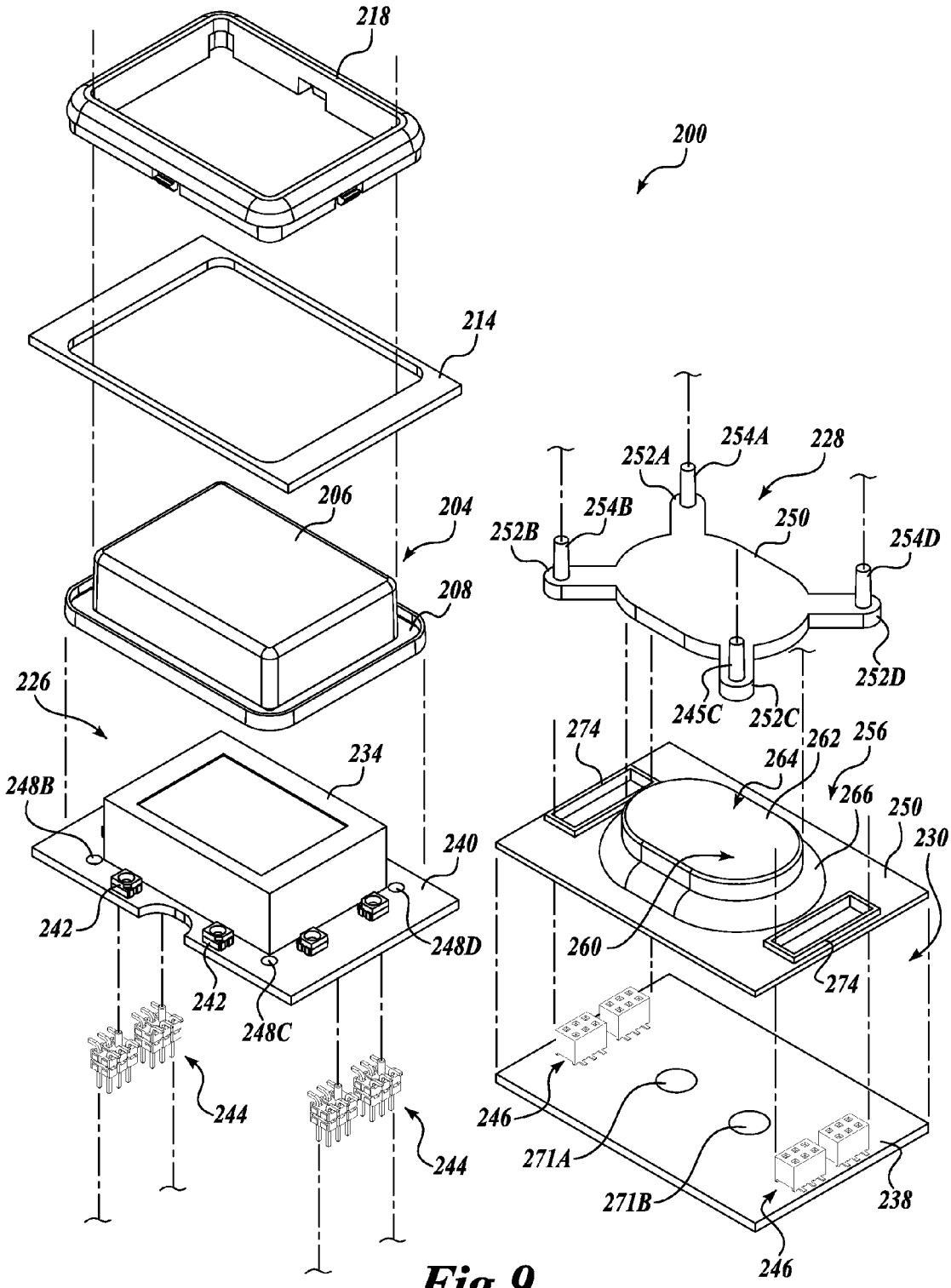
FIG. 9 is a top isometric exploded view of the switch assembly of FIG. 8.

Referring to FIGS. 8 and 9, a switch assembly 200 formed in accordance with another embodiment of the present disclosure is depicted. The switch assembly 200 is substantially similar in design to the switch assembly 100 described above with respect to FIGS. 4-7. The switch assembly 200 includes a lens 204 having a rectangular portion 206 and a flange 208, wherein the lens 204 is moveably receivable within a bezel 218 that is secured within an opening in a frame 214. The lens 204 substantially encloses at least a portion of a display assembly 226. Moreover, the lens 204 is engageable with an actuator 228 to activate an elastomeric switch 230 having a sealing switch layer 256 covering a switch circuit assembly 238.

The display assembly 226 differs from the display assembly 126 described above in that it includes a display 234, such as an LCD, OLED, etc., that is electrically mounted to a display/lighting PCB 240. As noted above, the display 234 may instead comprise a simple graphical image formed on a substrate. The display/lighting PCB 240 may include a plurality of light sources 242 (such as LEDs) mounted thereto and surrounding the display 234 such that the light sources 242 may selectively illuminate at least a portion of the lens 204 in lieu of or in addition to any images displayed on the display 234.

The display/lighting PCB 240 is electrically connected to the switch circuit assembly 238 through a suitable connector pin assembly. For instance, the connector pin assembly may comprise a plurality of connector pins 244 electrically connected to the display/lighting PCB 240 and extending downwardly therefrom. The connector pins 244 are arranged for connection with a plurality of connectors 246 electrically connected to the switch circuit assembly 238. The connectors 246 may be sealing received within openings 274 formed in the sealing switch layer 256 of the elastomeric switch 230. In this manner, the display PCB 240 may fixedly and electrically couple the display to the switch circuit assembly 238 without substantially compromising the sealing effect of the sealing switch layer 256

The actuator 228 is similar to the actuator 128 described above in that it includes a body portion 250 configured to engage a key 260 of an elastomeric switch member 264 formed on the sealing switch layer 256. Moreover, the actuator 228 includes first, second, third, and fourth radially projecting fingers 252A, 252B, 252C, and 252D, respectively, extending outwardly from the body portion 250 along substantially the same plane as the body portion 250. However, the actuator 228 further includes first, second, third, and fourth actuator posts 254A, 254B, 254C, and 254D, respectively, extending upwardly and substantially transversely from the end of each radially projecting finger 252A, 252B, 252C, and 252D. The actuator posts 254A, 254B, 254C, and 254D extend through openings 248A (not shown), 248B, 248C, and 248C, respectively, formed in the display/lighting PCB 240 around the display 234. The actuator posts 254A, 254B, 254C, and 254D are suitably located on each finger 252A, 252B, 252C, and 252D and are of a sufficient length to be moveably engaged by each corner of the flange 208 surrounding the lens 204 when the lens 204 is depressed.

Figure 10A:
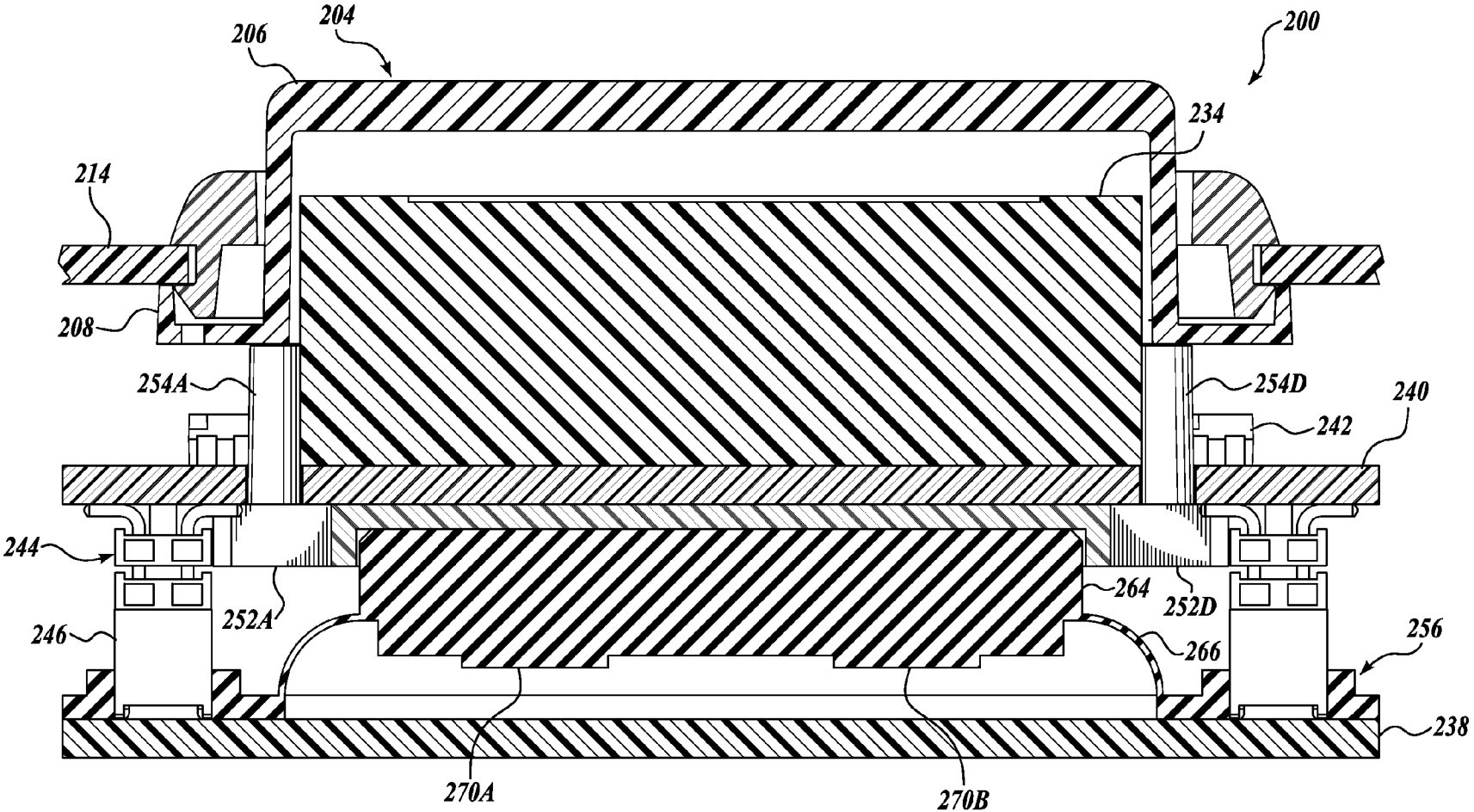
FIG. 10A is a cross-sectional view of the switch assembly of FIG. 8 taken substantially across line 10-10, wherein the switch assembly is shown in a first position.
Figure 10B:
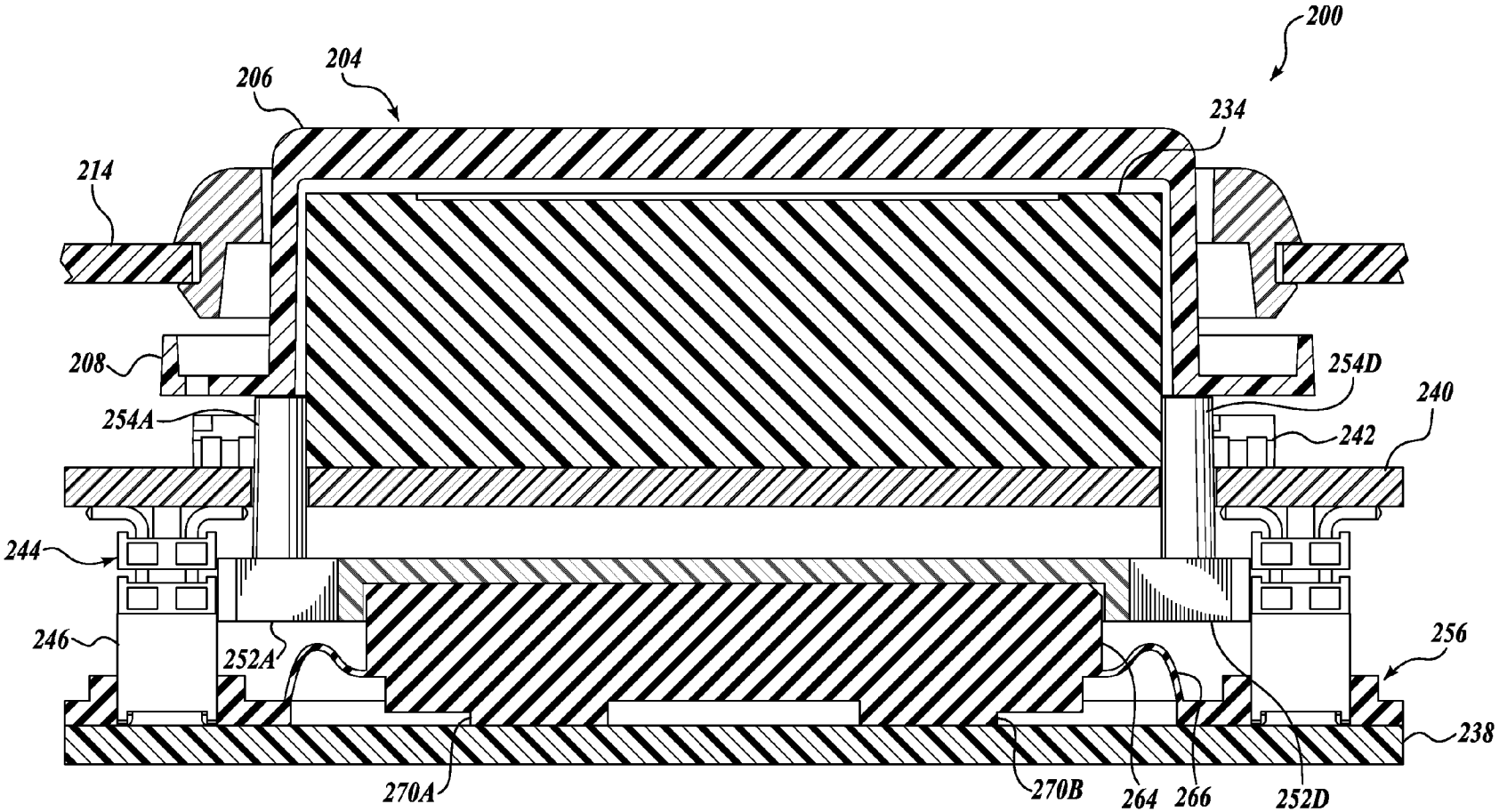
FIG. 10B is a cross-sectional view of the switch assembly of FIG. 8 taken substantially across line 10-10, wherein the switch assembly is shown in a second position.

Referring to FIGS. 10A and 10B, to operate the switch assembly 200, a player applies a predetermined load to the lens 204 (for instance, with his or her finger), and the flange 208 of the lens 204 applies the load to the actuator posts 254A, 254B, 254C, and 254D of the actuator 228. The load is transferred from the actuator posts 254A, 254B, 254C, and 254D to the radially projecting fingers 252A, 252B, 252C, and 252D and the body portion 250 of the actuator 228, and the body portion 250 transfers the load to the key 262 of the elastomeric switch member 264. The web 266 of the elastomeric switch member 264 buckles under the predetermined load and allows the key 262 to move downwardly into engagement with the switch circuit assembly 238 until the circuit-closing contacts 270A and 270B of the key 262 come into contact with traces 271A and 271B (see FIG. 9) on the switch circuit assembly 238 and close the circuit of the elastomeric switch 230. As the lens 204, actuator 228, and elastomeric switch member 264 move in response to the predetermine load, the display assembly 226 remains substantially stationary within the interior of the lens 204.

As noted above with respect to the switch assembly 100, the elastomeric switch 230 may be designed to provide a tactile response, a linear response, or another suitable response when the lens 204 is depressed. Moreover, the elastomeric switch 230 may instead include a membrane switch, a mechanical switch, or any other suitable switch or combination of switch features disposed beneath or otherwise integrally formed within the sealing switch layer 256.

If a liquid is poured over the switch assembly 200, the lens 204 and the sealing switch layer 256 help prevent the internal components of the switch assembly 200 from becoming damaged in a manner similar to that described above with respect to the lens 104 and sealing switch layer 156 of switch assembly 100.

Referring to FIGS. 11-18, a switch assembly 300 formed in accordance with another embodiment of the present disclosure is depicted. The switch assembly 300 will be hereinafter described with reference to a gaming environment; however, it should be appreciated that the switch assembly 300 may instead be used in any suitable or similar environment. Moreover, the switch assembly 300 may be integrated within a device having only a single switch assembly or, instead, within a device having multiple switch assemblies defining a programmable button panel (PBP). Thus, the following description should not be seen as limiting the scope of the claimed subject matter.

Figure 11:
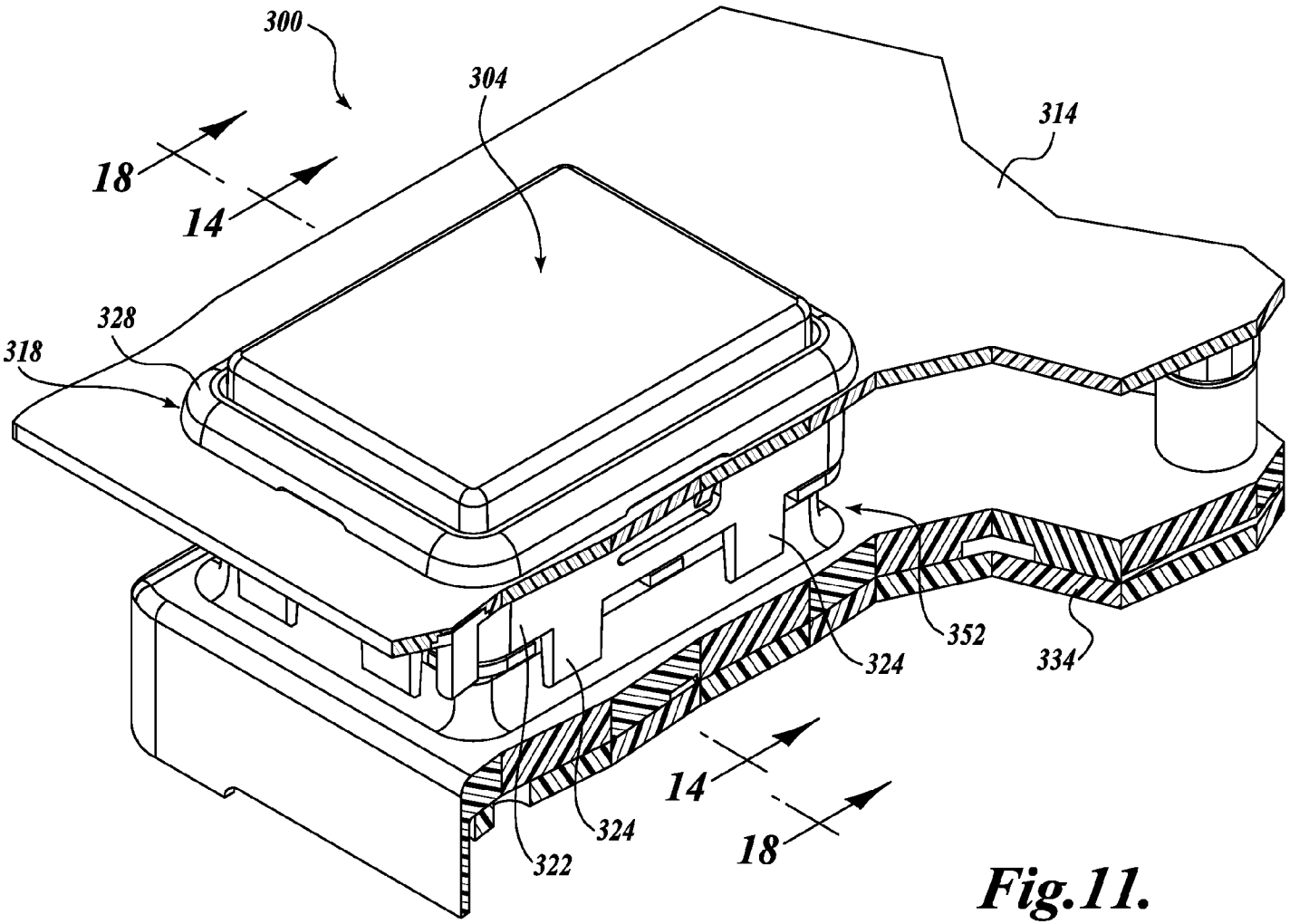
FIG. 11 an isometric view of a switch assembly formed in accordance with another embodiment of the present disclosure.
Figure 12:
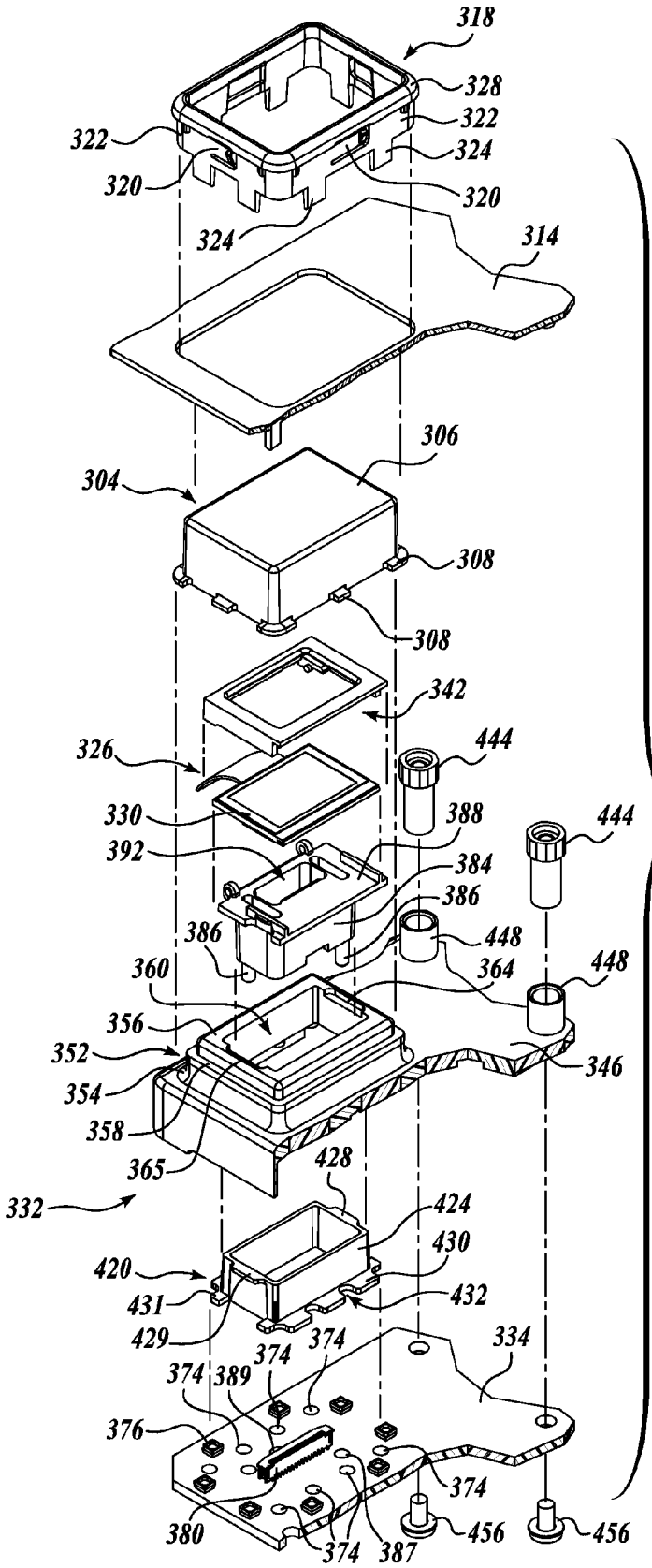
FIG. 12 is a top isometric exploded view of the switch assembly of FIG. 11.
Figure 13:
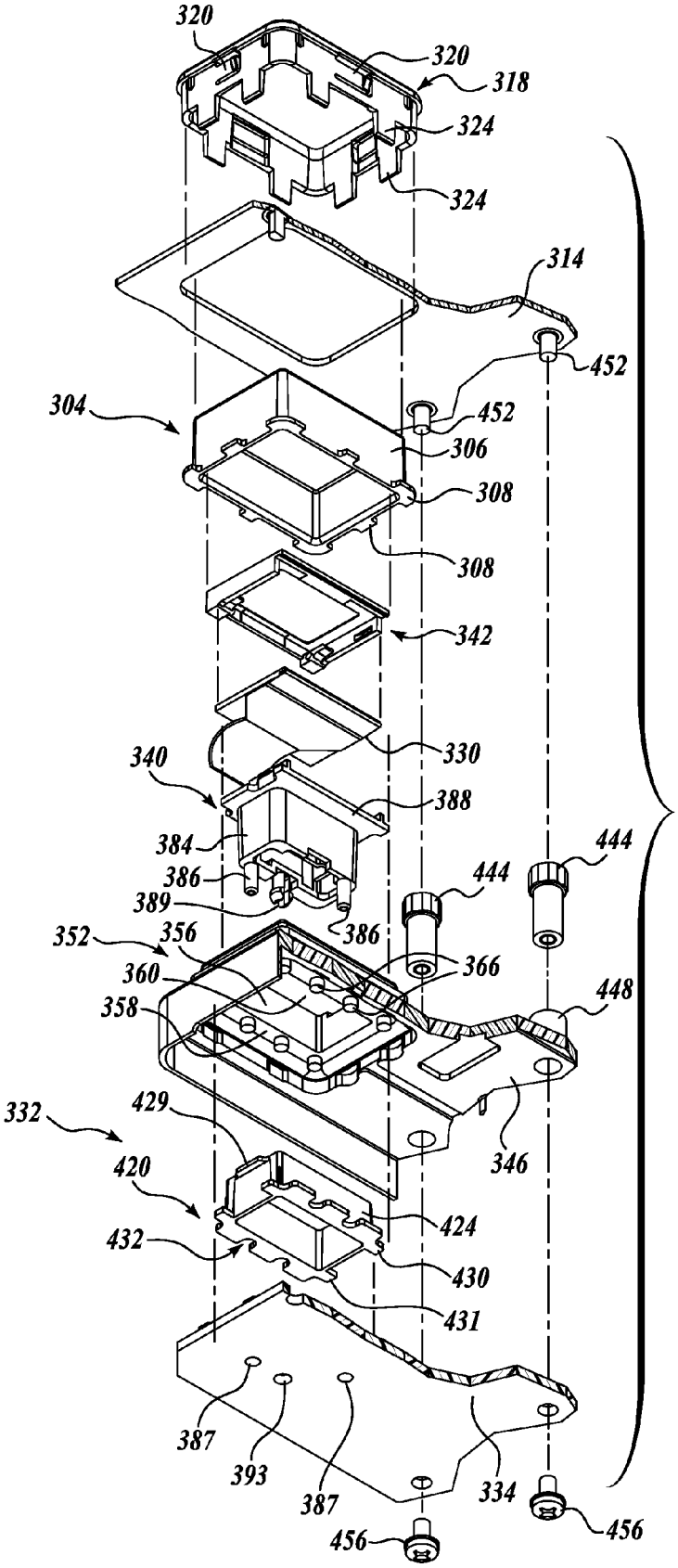
FIG. 13 is a bottom isometric exploded view of the switch assembly of FIG. 11.

Referring to FIGS. 11-13, the switch assembly 300 includes a transparent or translucent button or lens 304 having a hollow rectangular portion 306 defining a bottom opening and a plurality of flange portions 308 extending substantially transversely from the bottom, open edge of the hollow rectangular portion 306. The rectangular portion 306 of the lens 304 is receivable within an opening in a frame 314 made of sheet metal, plastic, etc., that is substantially flat such that it may define a portion of a panel of a gaming device or another suitable device.

A bezel 318 is receivable within the opening in the frame 314 and protrudes upwardly therefrom to finish the edge of the frame 314 and to surround the lens 304. The bezel 318 may help act as a guide for vertical movement of the lens 304 when being depressed by a player. The bezel 318 may be any suitable or desired shape and configuration appropriate to surround the lens 304. In the depicted embodiment, the bezel 318 includes a substantially hollow rectangular body 322 having top and bottom openings, and a lip 328 protruding from the upper open edge of body 322. The body 322 extends downwardly into the opening defined by the frame 314, surrounding the lens 304. Moreover, the flange portions 308 of the lens 304 are engageable with the bottom edge of the body 322 to retain the lens 304 within the bezel 318.

A plurality of light pipes 324 extend downwardly from the body along substantially the same plane as the body 322. The light pipes 324 may be any suitable size, shape, and configuration to help channel light upwardly from within the switch assembly 300 toward the upper exposed portion of the bezel 318, as will be described in further detail below. In that regard, the bezel 318 may be made from a suitable material transmit light through the bezel 318, such as a transparent or translucent plastic or similar material.

The bezel 318 may be releasably secured within the opening in the frame 314 in any suitable manner. For instance, the bezel 318 may include a plurality of snap locking features 320 formed on the body 322 that allow the bezel 318 to be snap-fit within the opening in the frame 314. The material of the bezel 318 may also be at least somewhat deformable such that the lip 328 may be deformed inwardly to release the snap locking features 320 from engagement with the frame 314 so that the bezel 318 may be lifted upwardly and outwardly from within the frame 314. Although the bezel 314 is shown and described as being separately mateable with the frame 314, in other embodiments the bezel 318 may be integrally formed with the frame 314, such as through injection molding or by another suitable method.

It should be appreciated that the lens 304 and bezel 318, as well as the other components of the switch assembly 300 that will be hereinafter described, may be any suitable shape and size. For instance, the switch assembly 300 may instead be of any overall circular shape or another irregular shape. Thus, the description and illustrations provided herein should not be seen as limiting the scope of the present disclosure.

Figure 14:
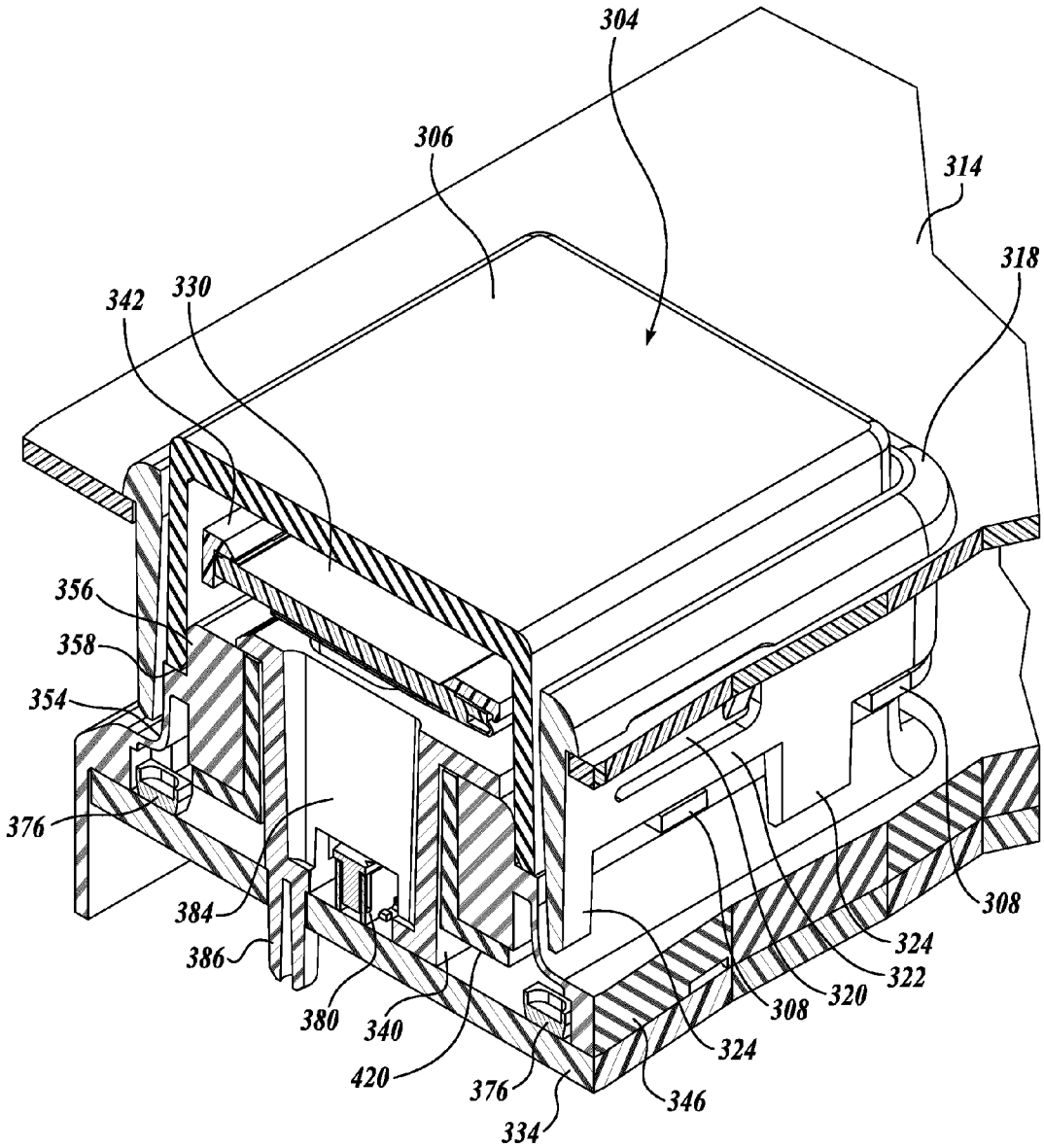
FIG. 14 is an isometric cross-sectional view of the switch assembly of FIG. 11 taken substantially across line 14-14.

Referring to FIGS. 12-14, the lens 304 covers and encloses a portion of a display assembly 326 positioned above an elastomeric switch 332. The display assembly 326 includes a display 330, such as a liquid crystal display (LCD), an organic light-emitting display (OLED), etc., that is electrically connected to a switch/lighting electrical circuit assembly 334 of the elastomeric switch 332 through a cable 338 (see FIGS. 18A and 18B), such as a well known flexible tail or another suitable flexible circuit or data cable. The display 330 is preferably programmable to display unique graphical images depending on the function selected by the player, the game being played, etc. For instance, the image on the display 330 may change when the elastomeric switch 332 is opened or closed in response to movement of the lens 304. It should be appreciated that any suitable display now known or later developed may be used. For example, the display may instead comprise a simple graphical image formed on a substrate, such as paper, film, etc.

Figure 15:
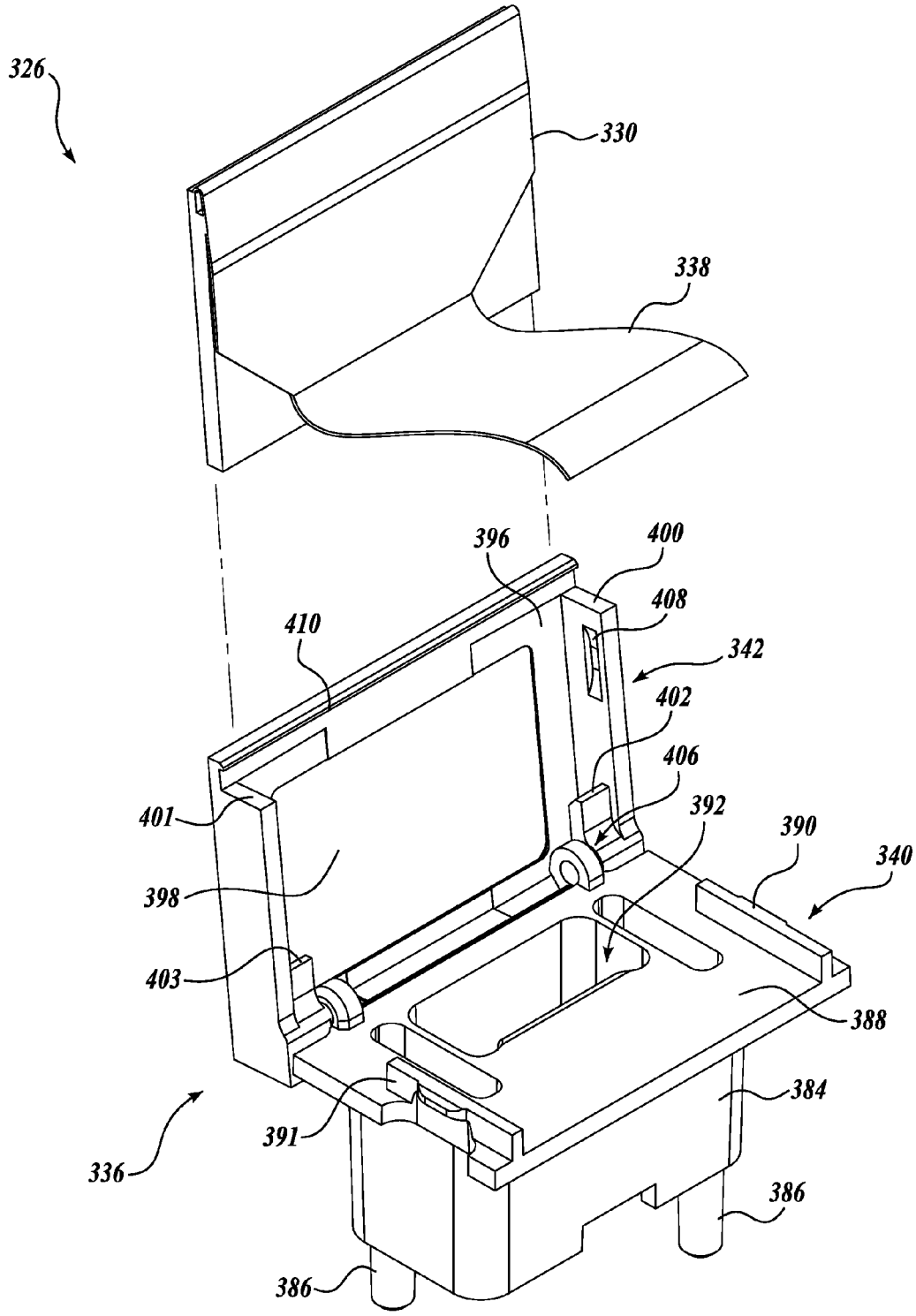
FIG. 15 a partially exploded isometric view of a display assembly of the switch assembly of FIG. 11.
Figure 16:
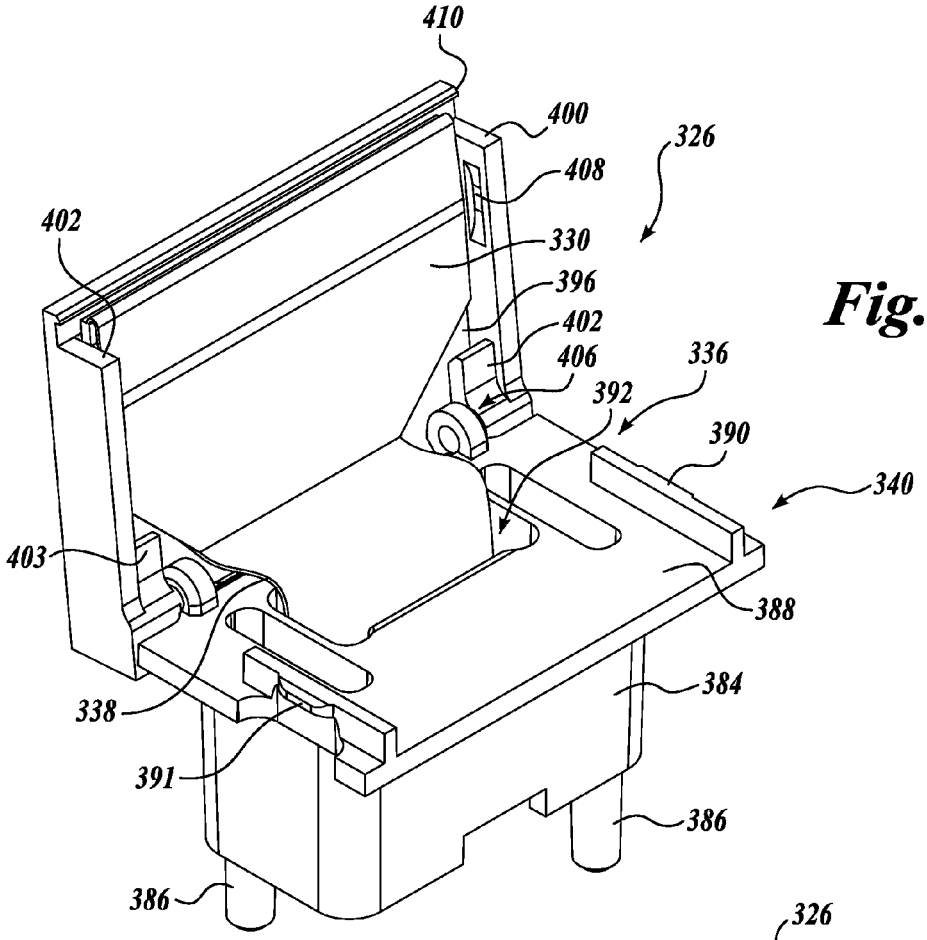
FIG. 16 is an isometric view of the display assembly of FIG. 12, wherein a the display assembly is shown in a first position.
Figure 17:
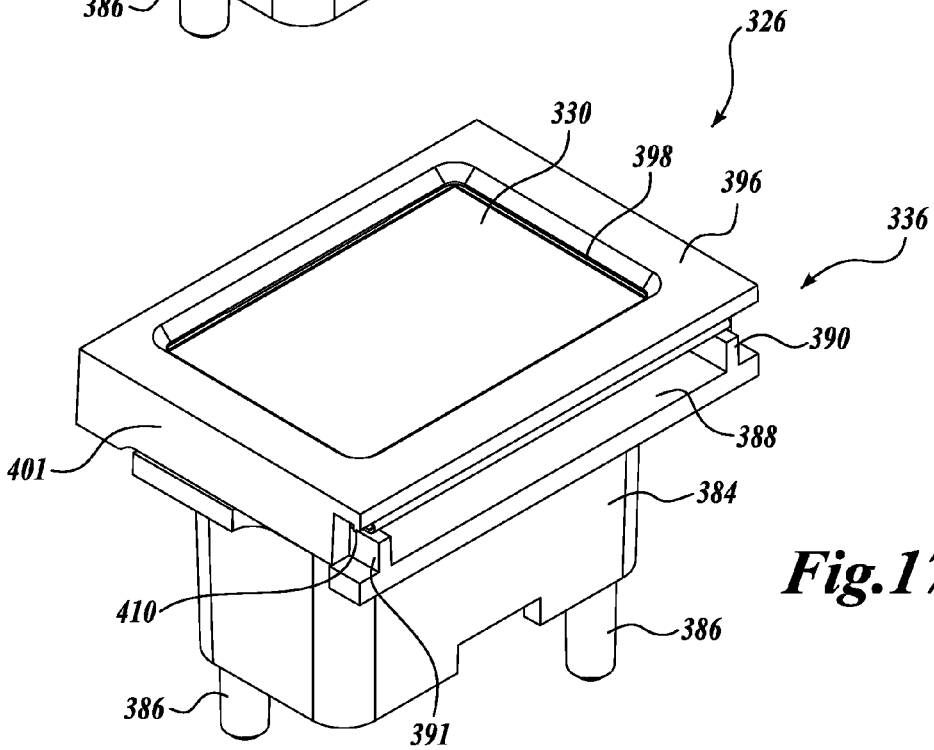
FIG. 17 is an isometric view of the display assembly of FIG. 12, wherein the display assembly is shown in a second position.

Referring additionally to FIGS. 15-17, the display 330 is mounted within a display box 336 that is configured to appropriately position and removably secure the display 330 within the switch assembly 300. The display box 336 includes a display box top member 342 connected to a display box bottom member 340. Although the display box bottom member 340 may be any suitable shape and configuration, the depicted display box bottom member 340 includes a substantially rectangular body portion 384 and one or more mounting posts 386 extending downwardly from the body portion 384. The one or more mounting posts 386 are receivable within openings 387 formed within the switch/lighting circuit assembly 334 to appropriately position the display assembly 326 within the switch assembly 300. A snap-fit feature 389 may also extend downwardly from the body portion 384, which is receivable within an opening 393 formed within the switch/lighting circuit assembly 334 to releasably secure the display assembly to the switch/lighting circuit assembly 334.

A platform 388 is formed on or otherwise secured to an upper end of the body portion 384. The platform 388 is positioned substantially transverse to the body portion 384 and is configured to engage the display box top member 342 when the display box top member 342 is moved into a closed position. In that regard, first and second snap fit features 390 and 391 extend upwardly from opposite edges of the platform 388 that are engageable with detents 408 formed within the display box top member 342 to temporarily secure the display box top member 342 in a closed position.

An opening 392 is formed within the platform 388 and extends downwardly through the body portion 384 to receive the cable 338 of the display 330 so that the cable 338 may be mated with a connector 380 on the switch/lighting circuit assembly 334. Although any suitable connector 380 may be used, in the depicted embodiment, the connector 380 is a zero insertion force (ZIF) connector. In this manner, the cable 338 may be easily connected and disconnected from the connector 380 through the opening 392 with minimal force or effort.

The display box top member 342 may be connected to the display box bottom member 340 in any suitable manner. In the depicted embodiment, the display box top member 342 is hingedly connected to the bottom member 340 through one or more hinge assemblies 406 of any suitable design such that the display box top member 342 may be moved about the hinge assemblies 406 between an open position and a closed position.

The display box top member 342 is also suitably designed to removably receive the display 330 therein such that the display 330 may be moved with the display box top member 342 between the open and closed positions. In that regard, the display box top member 342 includes a frame 396 having a display opening 398 that is sized and shaped to allow the images on the display 330 to show through the display box top member 342 when the display 330 is aligned with or positioned against the display box top member 342.

First and second side members 400 and 401 are formed along each side edge of the display box top member 342 and extend substantially transversely outwardly from the frame 396. Each of the side members 400 and 401 include a detent 408 (only detent 408 shown on side member 400 for clarity) formed on its inner surface. As briefly described above, the first and second snap fit features 390 and 391 formed on the display box bottom member 340 are receivable within the detents 408 to selectively secure the display box top member 342 in the closed position.

Although the depicted embodiment is shown having one or more hinge assemblies 406 for moveably securing the display box top member 342 to the display box bottom member 340, in other embodiments, the display box top member 342 may be simply removably secured to the bottom member 340 through a snap-fit assembly or other suitable assembly. For instance, the display box top member 342 may be simply snap fit onto the bottom member 340 through the first and second side members 400 and 401.

As noted above, the frame 396 of the display box top member 342 includes an opening 398 through which the images on the display 330 may be seen when the display 330 is positioned against the display box top member 342. To appropriately position the display 330 relative to the frame 396 and to secure the display 330 within the display box top member 342, the display box top member 342 includes first and second display flanges 402 and 403 extending inwardly from the first and second side members 400 and 401. The first and second display flanges 402 and 403 are spaced from the interior surface of the frame 396 to define a gap between the display flanges 402 and 403 and the interior surface of the frame 396. The display 330 is slidably receivable between the display flanges 402 and 403 and the frame 396 to secure the display 330 against the interior of the frame 396, as shown in FIG. 16. A lip 410 may extend along an edge of the display box top member 342 opposite the hinge assemblies 406 and between the first and second side members 400 and 401 to retain the display 330 in its position within the display box top member 342.

With the display 330 received within the display box top member 342 in this manner, the display 330 moves with the display box top member 342 between the open and closed positions, as shown in FIGS. 16 and 17. In the open position, as shown in FIG. 16, the display 330 may be moved into and out of the display box top member 342. Moreover, with the display box top member 342 moved into the open position, the connector 380 on the switch/lighting circuit assembly 334 is accessible to detach the cable 338 therefrom to completely remove the display 330 and its cable 338 from the display box 336.

In the closed position, as shown in FIG. 17, the display 330 is visible through the opening 398 in the frame 396. As such, the images on the display 330 can be seen through the lens 304 when the display assembly 326 is appropriately positioned beneath the lens 304. In that regard, the display box bottom member 340 is configured to appropriately position the display box top member 342 and display 330 within the hollow rectangular portion 306 of the lens 304 when the switch assembly 300 is assembled so that the images on the display 330 are visible through the lens 304.

Moreover, the display box bottom member 340 is of a predetermined height to position the display box top member 342 and display 330 in a desired vertical location beneath the lens 304. Preferably, the display box top member 342 and display 330 are mounted a sufficient distance below the interior upper surface of the lens 304 such that the display assembly 326 remains substantially stationary when the lens 304 is moved between the depressed and released positions while the images on the display 330 remain visible through the lens 304. However, it should be appreciated that in alternate embodiments, the display 330 may be secured within the switch assembly 300 such that it is moveable with the lens 304.

The display box 336 is further designed and configured to provide access to the display 330 and its associated cable 338 (for repair, service, maintenance, etc.) without having to disassemble the entire switch assembly 300. Rather, to access the display assembly 326, the bezel 318 and lens 304 are removed from within the frame 314 such that the display box top member 342 is exposed through the opening in the frame 314. The display box top member 342 may be thereafter moved about the hinge assemblies 406 into the open position (or otherwise disconnected from the display box bottom member 340), and the display 330 may be accessed through the opening in the frame 314. The cable 338 may be thereafter disconnected from the connector 380, and the display 330 may be slid outwardly from within the display box top member 342. It should be appreciated that any other suitable configuration for a display box 336 that removably secures and appropriately positions the display 330 within the switch assembly 300 may instead be used.

To help provide shielding of the electronics of the display assembly 326 and/or the other electrical components of the switch assembly 300 (such as electrostatic discharge shielding, electromagnetic interference shielding, etc.), a shield may be formed between or otherwise disposed between the display box top member 342 and the display box bottom member 340. For instance, the display box bottom member 340 could be coated or plated with a conductive layer on its inner surface, and a shield could be disposed between the display box top and bottom members 342 and 340. As a specific example, an indium tin oxide film could be disposed between the display box top and bottom members 342 and 340 with the conductive side of the film engaging the conductive coating of the display box top member 342. It should be appreciated that any suitable shield assembly may instead be used to appropriately shield the components of the switch assembly 300.

Referring again to FIGS. 12-14, the elastomeric switch 332 will now be described in detail. The elastomeric switch 332 is generally configured to be activated (i.e., open or closed) when the lens 304 is depressed or released. The elastomeric switch 332 is generally comprised of a sealing switch layer 346 disposed above the switch/lighting circuit assembly 334, wherein the sealing switch layer 346 is sized and shaped to substantially cover and seal the switch/lighting circuit assembly 334. The sealing switch layer 346 may be formed from any suitable, well known elastomeric, water resistant or waterproof material, such as silicone rubber. In this manner, the sealing switch layer 346 seals the switch/lighting circuit assembly 334 and prevents liquids from reaching the PCB 334. Moreover, the sealing switch layer 346 can protect the switch/lighting circuit assembly 334 if, for instance, cleaning liquids are poured over the switch assembly 300 to remove dirt, residue, etc.

The sealing switch layer 346 includes an elastomeric switch member 352 that may be integrally formed within the sealing switch layer 346. The elastomeric switch member 352 is configured to open or close a circuit when a portion of the elastomeric switch member 352 is depressed and engages the switch/lighting circuit assembly 334. The elastomeric switch member 352 of the switch assembly 300 includes an actuator, or web 354 that extends upwardly from the upper surface of the sealing switch layer 346. The web 354 is of a predetermined contour and thickness such that the web 354 flexes inwardly and downwardly upon application of a predetermined force on the elastomeric switch member 352. The web 354 provides a predetermined actuation force to open or close the elastomeric switch 332 when the lens 304 is depressed or released. The depicted web 354 provides a linear actuation force; however, in other embodiments, the web 354 may be designed to provide a tactile response or another desired response.

Figure 18A:
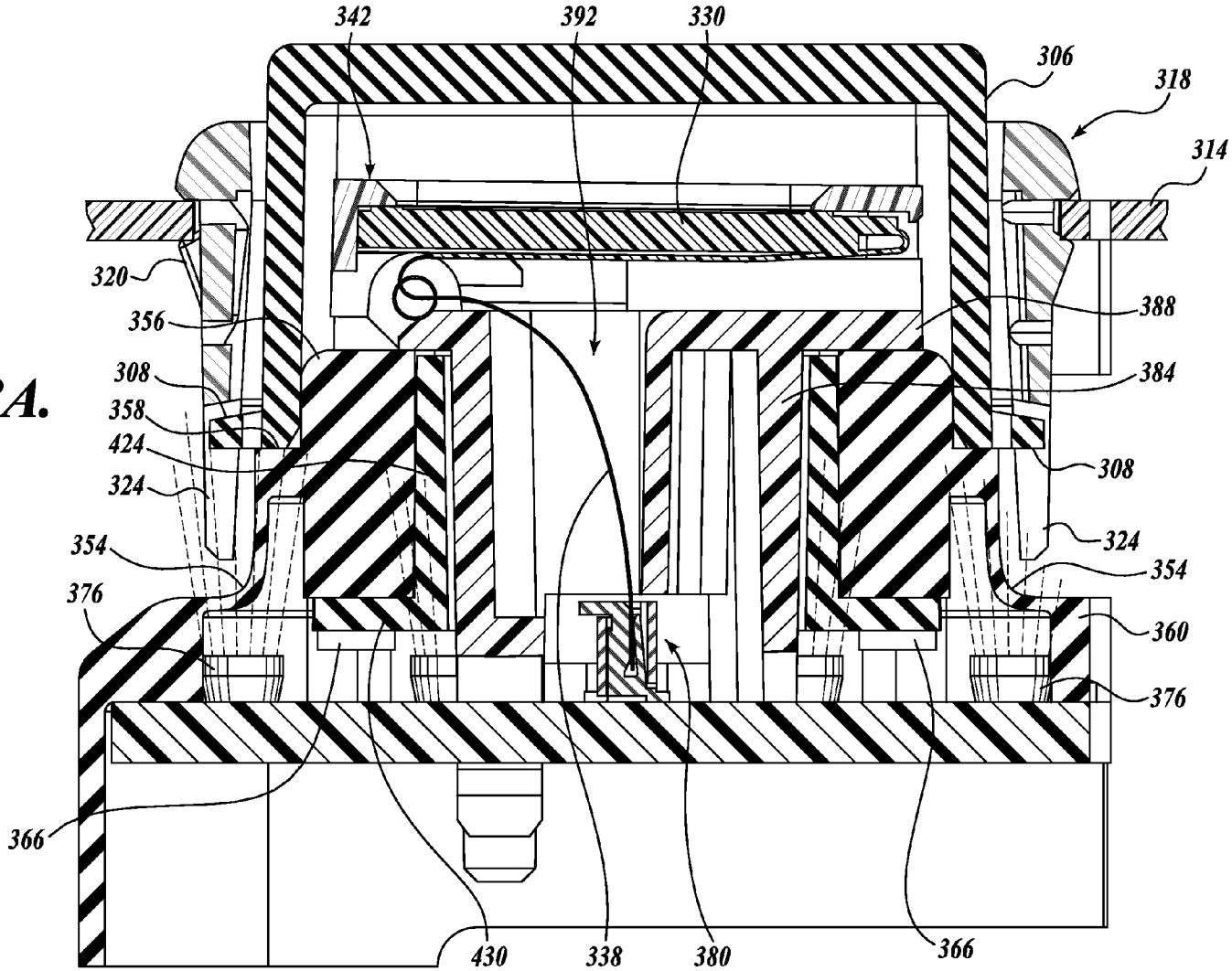
FIG. 18A is a cross-sectional view of the switch assembly of FIG. 11 taken substantially across line 18-18, wherein the switch assembly is shown in a first position.
Figure 18B:
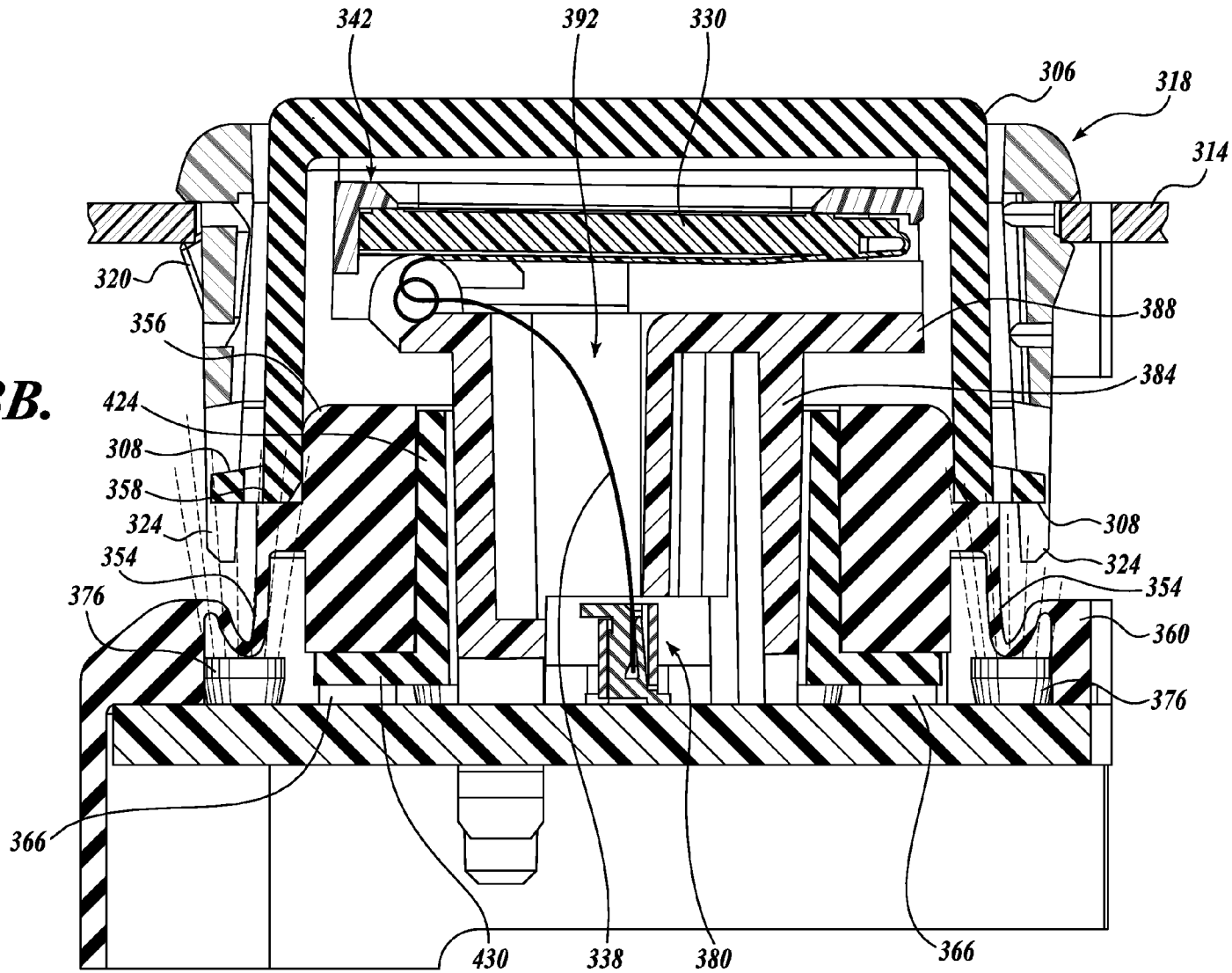
FIG. 18B is a cross-sectional view of the switch assembly of FIG. 11 taken substantially across line 18-18, wherein the switch assembly is shown in a second position.

The elastomeric switch member 352 further includes an actuator shoulder 358 that extends transversely inwardly from the web 354. The actuator shoulder 358 is positioned to engage the bottom edge of the lens 304 and transfer load exerted on the lens 304 to the elastomeric switch member 352. More specifically, when the lens 304 is depressed by a user, the lens 304 engages the actuator shoulder 358 and moves the actuator shoulder 358 downwardly, as shown in FIGS. 18A and 18B.

A lens receiving portion 356 extends upwardly from the inner edge of the actuator shoulder 358. The lens receiving portion 356 is substantially sized and shaped to be tightly and sealingly received within a portion of the hollow rectangular portion 306 of the lens 304 (see FIG. 14). A display opening 360 is formed within the lens receiving portion 356, and the display opening 360 is sized and configured to receive a portion of the display assembly 326 therein. More specifically, the body portion 384 of the display box bottom member 340 is receivable within the display opening 360. In this manner, the display assembly 326 can be mounted to the switch/lighting circuit assembly 334 but can also protrude upwardly into the hollow rectangular portion 306 of the lens 304. Moreover, with the lens receiving portion 356 sealingly received within a portion of the hollow rectangular portion 306 of the lens 304, any liquid spilled onto the switch button assembly 300 passes over the exterior of the lens 304, down through the opening between the lens 304 and the bezel 318, and onto the sealing switch layer 346, without reaching the display assembly 326.

The lens receiving portion 356 also extends downwardly from the inner edge of the actuator shoulder 358 and includes a plurality of circuit-closing contacts 366, or "carbon pills" as are well known in the art, embedded within or otherwise secured to the bottom surface of the lens receiving portion 356. Each circuit-closing contact 366 is engageable with a trace 374 on the switch/lighting circuit assembly 334 when the lens 304 is depressed to actuate the elastomeric switch member 352. The circuit-closing contacts 366 are covered with a conductive rubber material such that they close one or more circuits when coming into contact with the traces 374 on the PCB 334.

As discussed above with respect to the switch assemblies 100 and 200, the elastomeric switch 332 may instead include a membrane switch, a mechanical switch, or any other suitable switch or combination of switch features disposed beneath or otherwise integrally formed within the sealing switch layer 256. Accordingly, the foregoing description should not be seen as limiting the scope of the claimed subject matter.

A bushing 420 may be disposed between the lens receiving portion 356 and the display box bottom member 340 to enable movement of the lens receiving portion 356 relative to the display box bottom member 340 when the elastomeric switch member 352 is moved by the lens 304. As can be seen by further referring to FIGS. 18A and 18B, the bushing 420 includes a hollow rectangular body 424 that is sized and shaped to surround the body portion 384 of the display box bottom member 340, and it is also sized and shaped to be received within the display opening 360 in the lens receiving portion 356 of the elastomeric switch member 352. In this manner, the bushing 420 acts as a bearing surface between the lens receiving portion 356 and the display box bottom member 340. In that regard, the bushing 420 may be made from any suitable material to allow for relative motion between the lens receiving portion 356 and the display box bottom member 340, such as acetal plastic or another similar material. The bushing 420 is also made from a suitable material to increase the rigidity of the lens receiving portion 356 to enhance the sealing connection between the lens receiving portion 356 and the hollow rectangular portion 306 of the lens 304.

To help secure the bushing 420 within the display opening 360, the bushing 420 includes outwardly extending tactile switch member engaging flanges 428 and 429 formed on opposite upper edges of the hollow rectangular body 424 that are receivable within first and second opposing flange cavities 364 and 365 formed within the upper surface of the lens receiving portion 356. Furthermore, the bushing 420 includes first and second flanges 430 and 431 formed on opposite lower edges of the hollow rectangular body 424 that are engageable with the elastomeric switch member 352. The flanges 430 and 431 include circuit-closing contact recesses 432 formed along their length that receive the circuit-closing contacts 366 therein when the bushing 420 is mated with the elastomeric switch member 352. The circuit-closing contacts 366 are greater in thickness than the flanges 430 and 431 such that the circuit-closing contacts 366 may engage the traces 474 on the switch/lighting circuit assembly 334 when the elastomeric switch member 352 is depressed (See FIGS. 18A and 18B).

It can be understood from the above description that the elastomeric switch member 352 uses inexpensive, simple parts to open or close the elastomeric switch 332, as opposed to the costly optical sensor assembly described above with respect to the prior art switch assembly 12. The elastomeric switch member 352 further provides the advantage of using fewer parts that are simple in design to continuously urge the lens 304 into a released (non-depressed) position and to create a linear, tactile, or other sensation of a fully depressed lens. As discussed above, the prior art switch assembly 12 uses a plurality of springs 84 and deformable plungers 80 having snap features to allow the lens 18 to move into the depressed position and to urge the lens 18 into the released, non-depressed position.

The elastomeric switch member 352, on the other hand, includes a simple web 354 encircling the lens receiving portion 356 and the actuator shoulder 358. The web 354 is configured to urge the lens receiving portion 356 and the actuator shoulder 358 (and therefore the lens 304) into the released, non-depressed position when the player applies a predetermined force to the lens 304. As can be appreciated by one or ordinary skill, the web 354 can vary in angle, thickness, nominal height, contour, etc., to increase or decrease the predetermined amount of force required to cause the web 354 to buckle and to produce an increased or decreased linear or tactile response.

The elastomeric switch member 352 further has a lifespan much greater than the small, delicate pieces of the prior art switch assembly 12. The web 354 must simply buckle to move the circuit-closing contacts 366 into engagement with the switch/lighting circuit assembly 334, as opposed to the plungers 80 that will fail due to abrasion, wear, and deformation. Moreover, the elastomeric material of the elastomeric switch member 352 can better absorb forces applied to the switch assembly 300 in the abusive gaming environment, as opposed to the small, delicate pieces of the prior art switch assembly 12 that are more susceptible to breaking.

The switch assembly 300, when activated to close a circuit, may send signals to a controller within the gaming unit or to a controller or computer external of the gaming unit through suitable wired or wireless technologies (not shown) well known in the art. Upon receiving the signal that the circuit has been closed, the controller may, for example, output a signal to activate or change the image on the display 330.

The switch assembly 300 may further include a plurality of light sources 376, such as light-emitting diodes (LEDs) electrically connected to the switch/lighting circuit assembly 334 that may be illuminated individually or collectively in response to input signals received from the controller, external computer, etc. The light sources 376 are preferably positioned around the exterior perimeter of the switch/lighting circuit assembly 334 such that they are positioned beneath the web 354 of the elastomeric switch member 352. The elastomeric switch member 352 may be made from a transparent or translucent elastomeric material so that light from the light sources 376 may be directed upwardly through the web 354 toward the bezel 314. Moreover, the light pipes 324 of the bezel 314 may be positioned to correspond to one of each of the light sources 376. More specifically, each light pipe 324 extends downwardly from the bezel 318 toward a corresponding light source 376 to provide optical coupling to the respective light source. In this manner, the light from the light sources 376 shines through the web 354 and up through the light pipes 324 to illuminate the bezel 318.

Referring to FIGS. 12 and 13, the manner in which the switch assembly 300 is assembled will now be described. The switch assembly 300 is assembled such that the components of the switch assembly 300 are generally disposed between the frame 314 and the switch/lighting circuit assembly 334. One or more studs 452 extend downwardly from the bottom surface of the frame 314 that are receivable within openings in one or more corresponding stand-offs 444. The studs 452 may be threadably received within the stand-offs 444 or otherwise secured within the stand-offs 444 in any other suitable manner. The stand-offs 444 are sealingly received within elastomeric sleeves 448 integrally formed within the sealing switch layer 346.

To secure the frame 314 to the switch/lighting circuit assembly 334, one or more fasteners 456 are passed through openings in the switch/lighting circuit assembly 334 and are received within openings in the in the sealing switch layer 346 that align the elastomeric sleeves 448. The fasteners 456 may be thereafter secured within threaded openings in the stand-offs 444 to sealingly secure the frame 314 to the switch/lighting circuit assembly 334. By securing the studs 452 and the fasteners 456 to stand-offs 444 that are sealingly received within the elastomeric sleeves 448, the frame 314 is secured to the switch/lighting circuit assembly 334 without exposing any of the electronics on the switch/lighting circuit assembly 334.

Referring to FIGS. 18A and 18B, operation of the switch assembly 300 will be hereinafter described. To activate the elastomeric switch 332 of the switch assembly 300, a player applies a predetermined load to the lens 304 (for instance, with his or her finger), and the bottom edge of the lens 304 applies the load to the actuator shoulder 358 of the elastomeric switch member 352. The web 354 of the elastomeric switch member 352 buckles under the predetermined load and allows the lens-receiving portion 356 to move downwardly toward the switch/lighting circuit assembly 334 until the circuit-closing contacts 366 come into contact with the traces 374 (not shown in FIGS. 18A and 18B) on the switch/lighting circuit assembly 334 to close the circuit of the elastomeric switch 332. As the lens 204 and elastomeric switch member 352 move in response to the predetermine load, the display assembly 326 remains substantially stationary within the interior of the lens 304.

When an operator releases the lens 304, the web 354 is urged back into its non-deformed state to raise the lens-receiving portion 356 and the actuator shoulder 358. As such, the circuit-closing contacts 366 come out of contact with the traces 374 on the switch/lighting circuit assembly 334 to open the circuit of the elastomeric switch 332. Moreover, the movement of the actuator shoulder 358 raises the lens 304 back into its original, non-depressed state.

If a liquid is poured over the switch assembly 300, the liquid will be guided down through the gap between the lens 304 and the bezel 314 and onto the sealing switch layer 346 of the elastomeric switch 332. Any components sealed beneath the sealing switch layer 346, such as the switch/lighting circuit assembly 334, remain dry. Moreover, as described above, the display assembly 326 is partially received within the lens-receiving portion 356 of the sealing switch layer 346 and sealingly received within the rectangular portion 306 of the lens 304 through the lens-receiving portion 356. In this manner, the display 330 remains protected by the lens 304 and the sealing switch layer 346 and it stays substantially dry. Thus, the sealing features of the lens 304 and the sealing switch layer 346 help prevent the switch assembly 300 from becoming damaged when liquid is spilled onto the assembly.

While illustrative embodiments have been illustrated and described, it will be appreciated that various changes can be made therein without departing from the spirit and scope of the present disclosure.

The invention claimed is:

1. A switch assembly, comprising:

(a) a lens having a hollow interior;

(b) a display assembly at least partially received within the hollow interior of the lens;

(c) an actuator moveably engageable by the lens; and (d) an elastomeric switch activatable by the actuator in response to movement of the lens, wherein the elastomeric switch includes a sealing switch layer covering a circuit assembly and an elastomeric switch member formed within the sealing switch layer, the elastomeric switch member having at least one circuit-closing contact that is engageable with the circuit assembly to close a circuit on the circuit assembly; and wherein the elastomeric switch member includes a lens-receiving portion that is sealingly engageable with the hollow interior of the lens.

2. The switch assembly of claim 1, wherein the actuator is of a predetermined shape and size such that it is moveable by the lens and engageable with the elastomeric switch member.

3. The switch assembly of claim 1, wherein the actuator is defined by a portion of the elastomeric switch member that is moveable by the lens.

4. The switch assembly of claim 1, wherein the display assembly comprises:

(a) a display box bottom member securable to a portion of the elastomeric switch;

(b) a display box top member securable to the display box bottom member;

(c) a display removably securable within the display box top member.

5. The switch assembly of claim 1, wherein a portion of the display assembly is receivable within the lens-receiving portion.

6. The switch assembly of claim 5, further comprising a bushing disposed between the display assembly and the lens-receiving portion.

7. A switch assembly, comprising:

(a) a lens having a hollow interior;

(b) a display assembly at least partially received within the hollow interior of the lens;

(c) an elastomeric switch, comprising:

(i) a circuit assembly;

(ii) a sealing switch layer disposed over the circuit assembly; and (iii) an elastomeric switch member formed within the sealing switch layer that is actuatable by the movement of the lens for engagement with the circuit assembly, wherein the elastomeric switch member includes a lens-receiving portion that is sealingly engageable with the hollow interior of the lens.

8. The switch assembly of claim 7, wherein the elastomeric switch member includes at least one circuit-closing contact that is engageable with the circuit assembly to close a circuit on the circuit assembly.

9. The switch assembly of claim 7, wherein the elastomeric switch member includes an actuator shoulder that is of a predetermined shape and size such that it is moveable by the lens.

10. The switch assembly of claim 7, wherein a portion of the display assembly is receivable within the lens-receiving portion.

11. The switch assembly of claim 10, further comprising a bushing disposed between the display assembly and the lens-receiving portion.

12. The switch assembly of claim 7, wherein the display assembly comprises:

(a) a display box bottom member securable to a portion of the elastomeric switch;

(b) a display box top member securable to the display box bottom member;

(c) a display removably securable within the display box top member.

13. The switch assembly of claim 12, wherein the display box top member is disposed within the hollow interior of the lens such that the display box top member is accessible when the lens is removed from the switch assembly.

14. The switch assembly of claim 12, wherein the display box bottom member is mountable to the circuit assembly of the elastomeric switch such that the display remains substantially stationary when the lens is moved.

15. The switch assembly of claim 12, wherein the display box top member is moveable between an open position, wherein the display may be removed from the display box top member, and a closed position, wherein the display is positioned to display images through the lens.

16. The display assembly of claim 12, wherein the display box bottom member includes an opening for receiving a cable of the display, wherein the opening is in communication with a portion of the switch assembly such that the display may be selectively placed into electrical communication with the switch assembly.

17. A switch assembly, comprising:

(a) a lens having a hollow interior;

(b) an elastomeric switch, comprising:

(i) a circuit assembly;

(ii) a sealing switch layer disposed over the circuit assembly; and (iii) an elastomeric switch member formed within the sealing switch layer that is actuatable by the movement of the lens for engagement with the circuit assembly, wherein the elastomeric switch member includes a lens-receiving portion that is sealingly engageable with the hollow interior of the lens; and (c) a display assembly at least partially received within the hollow interior of the lens, the display assembly comprising:

(i) a display box bottom member securable to a portion of the elastomeric switch;

(ii) a display box top member securable to the display box bottom member; and (iii) a display removably securable within the display box top member, wherein the display box top member is moveable between an open position, wherein the display may be removed from the display box top member, and a closed position, wherein the display is positioned to display images through the lens.

18. A switch assembly, comprising:

(a) a lens having a hollow interior;

(b) an elastomeric switch that is activatable by the movement of the lens, wherein the elastomeric switch member includes a lens-receiving portion that is sealingly engageable with the hollow interior of the lens; and (c) a display assembly, comprising:

(i) a display mounting assembly at least partially disposed within the lens-receiving portion; and (ii) a display removably secured within the display mounting assembly such that the display is positionable within the hollow interior of the lens.

19. The switch assembly of claim 18, wherein the display mounting assembly comprises:

(a) a display box bottom member at least partially disposed within the lens-receiving portion; and (b) a display box top member securable to the display box bottom member, wherein the display is removably securable within the display box top member.

20. The switch assembly of claim 19, wherein the display box top member is disposed within the hollow interior of the lens such that the display box top member is accessible when the lens is removed from the switch assembly.

21. The switch assembly of claim 20, wherein the display box top member is moveable between an open position, wherein the display may be removed from the display box top member, and a closed position, wherein the display is positioned to display images through the lens.

* * * * *